US007787632B2

(12) United States Patent
Ojanpera

(10) Patent No.: US 7,787,632 B2
(45) Date of Patent: Aug. 31, 2010

(54) SUPPORT OF A MULTICHANNEL AUDIO EXTENSION

(75) Inventor: Juha Ojanpera, Nokia (FI)

(73) Assignee: Nokia Corporation, Espoo (FI)

( * ) Notice: Subject to any disclaimer, the term of this patent is extended or adjusted under 35 U.S.C. 154(b) by 727 days.

(21) Appl. No.: 10/548,227

(22) PCT Filed: Mar. 21, 2003

(86) PCT No.: PCT/IB03/01662

§ 371 (c)(1),
(2), (4) Date: Oct. 24, 2006

(87) PCT Pub. No.: WO2004/080125

PCT Pub. Date: Sep. 16, 2004

(65) Prior Publication Data

US 2007/0165869 A1 Jul. 19, 2007

(30) Foreign Application Priority Data

Mar. 4, 2003 (WO) ..... PCT/IB03/00793

(51) Int. Cl.
*H04R 5/00* (2006.01)
*G10L 19/00* (2006.01)
*G10L 19/02* (2006.01)
*G10L 19/04* (2006.01)

(52) U.S. Cl. ..... 381/23; 381/21; 381/22; 381/17; 381/18; 704/E19.005; 704/500; 704/203; 704/205; 704/200.1

(58) Field of Classification Search ..... 381/1, 381/2, 17–23; 704/E19.005, 200.1, 203, 704/205, 500
See application file for complete search history.

(56) References Cited

U.S. PATENT DOCUMENTS 5,539,829 A 7/1996 Lokhoff et al.
5,606,618 A * 2/1997 Lokhoff et al. ..... 381/2
5,812,672 A * 9/1998 Herre et al. ..... 381/2
5,890,125 A 3/1999 Davis et al.

(Continued)

FOREIGN PATENT DOCUMENTS

WO WO 03/007656 1/2003

(Continued)

OTHER PUBLICATIONS

"Psychoacoustics, Facts and Models;" E. Zwicker et al; Springer-Verlag.

(Continued)

*Primary Examiner*—Devona E Faulk
(74) *Attorney, Agent, or Firm*—Alfred A. Fressola; Ware, Fressola, Van Der Sluys & Adolphson LLP

(57) ABSTRACT

The invention relates to methods and units supporting a multichannel audio extension. In order to allow an efficient extension requiring a low computational complexity, it is proposed that at an encoding end, at least state information is provided as side information for a provided mono audio signal (M) generated out of a multichannel audio signal. The state information indicates for each of a plurality of frequency bands how a predetermined or equally provided gain value is to be applied in the frequency domain to the mono audio signal (M) for obtaining first and a second channel signals (L,R) of a reconstructed multichannel audio signal.

41 Claims, 11 Drawing Sheets

U.S. PATENT DOCUMENTS 6,016,473 A 1/2000 Dolby

FOREIGN PATENT DOCUMENTS

WO WO 03007657 1/2003

OTHER PUBLICATIONS

"Sum Difference Stereo Transform Coding;" J.D. Johnston et al; IEEE 1992.

"Why Binaural Cue Coding is Better than Intensity Stereo Coding;" Frank Baumgarte et al; Audio Engineering Society Convention Paper 5575; May 10-13, 2002; Munich, Germany.

"Text of ISO/IEC 14496-3:2001/FPDAM 1, Bandwidth Extension;" ISO/IEC JTC1/SC29/WG11 N5203; Oct. 2002, Shanghai, China.

"Analysis/Synthesis Filter Bank Design Based on Time Domain Aliasing Cancellation;" John P. Princen et al; IEEE Transactions on Acoustics, Speech and Signal Processing, vol. ASSP-34, No. 5, Oct. 1986.

"The Modulated Lapped Transform, its Time-Varying Forms, and Its Applications to Audio Coding Standards;" Seymour Shlien; IEEE Transactions on Speech and Audio Processing, vol. 5, No. 4, Jul. 1997.

"Restructured Audio Encoder for improved Computational Efficiency;" Ye Wang, et al; AES 108$^{th}$ Convention, Feb. 19-22, 2000, Paris, France.

"High-Level Description for the ITU-T Wideband (7kHz) ATCELP Speech Coding Algorithm . . . ;" J. Stegmann et al; Geneva, Jan. 26-Feb. 6, 1998.

"AMR-WB extension of high audio quality;" Nokia, Ericsson, VoiceAge; TSG-SA #24 meeting, 2002.

"Draft Work Item Description for AMR'WB extension for high audio quality;" Nokia et al; TSG-SA 2002.

* cited by examiner

```
HuffRunTable[27][3] = {
{ 0,  1,    0},
{ 1,  3,    7},
{ 2,  3,    5},
{ 3,  4,    9},
{ 4,  5,   26},
{ 5,  6,   34},
{ 6,  6,   32},
{ 7,  7,   71},
{ 8,  7,   70},
{ 9,  7,   67},
{10,  8,  223},
{11,  8,  133},
{12,  8,  132},
{13,  9,  445},
{14,  9,  444},
{15,  9,  437},
{16,  9,  436},
{17,  9,  439},
{18,  9,  438},
{19,  9,  433},
{20,  9,  432},
{21,  9,  435},
{22,  9,  434},
{23,  9,  441},
{24,  9,  440},
{25,  9,  443},
{26,  9,  442},
{27,  4,   12}
};
```

FIG. 5

SUPPORT OF A MULTICHANNEL AUDIO EXTENSION

CROSS REFERENCE TO RELATED APPLICATIONS

This application is for entry into the U.S. national phase under §371 for International Application No. PCT/IB04/001662 having an international filing date of Mar. 21, 2003, and from which priority is claimed under all applicable sections of Title 35 of the United States Code including, but not limited to, Sections 120, 363 and 365(c) and which in turn claims priority under 35 U.S.C. §119 to International Patent Application PCT/IB03/00793 filed on Mar. 4, 2003.

The invention relates to multichannel audio coding and to multichannel audio extension in multichannel audio coding. More specifically, the invention relates to a method for supporting a multichannel audio extension at an encoding end of a multichannel audio coding system, to a method for supporting a multichannel audio extension at a decoding end of a multichannel audio coding system, to a multichannel audio encoder and a multichannel extension encoder for a multichannel audio encoder, to a multichannel audio decoder and a multichannel extension decoder for a multichannel audio decoder, and finally, to a multichannel audio coding system.

FIELD OF THE INVENTION

Background of the Invention

Audio coding systems are known from the state of the art. They are used in particular for transmitting or storing audio signals.

FIG. 1 shows the basic structure of an audio coding system, which is employed for transmission of audio signals. The audio coding system comprises an encoder 10 at a transmitting side and a decoder 11 at a receiving side. An audio signal that is to be transmitted is provided to the encoder 10. The encoder is responsible for adapting the incoming audio data rate to a bitrate level at which the bandwidth conditions in the transmission channel are not violated. Ideally, the encoder 10 discards only irrelevant information from the audio signal in this encoding process. The encoded audio signal is then transmitted by the transmitting side of the audio coding system and received at the receiving side of the audio coding system. The decoder 11 at the receiving side reverses the encoding process to obtain a decoded audio signal with little or no audible degradation.

Alternatively, the audio coding system of FIG. 1 could be employed for archiving audio data. In that case, the encoded audio data provided by the encoder 10 is stored in some storage unit, and the decoder 11 decodes audio data retrieved from this storage unit. In this alternative, it is the target that the encoder achieves a bitrate which is as low as possible, in order to save storage space.

The original audio signal which is to be processed can be a mono audio signal or a multichannel audio signal containing at least a first and a second channel signal. An example of a multichannel audio signal is a stereo audio signal, which is composed of a left channel signal and a right channel signal.

Depending on the allowed bitrate, different encoding schemes can be applied to a stereo audio signal. The left and right channel signals can be encoded for instance independently from each other. But typically, a correlation exists between the left and the right channel signals, and the most advanced coding schemes exploit this correlation to achieve a further reduction in the bitrate.

Particularly suited for reducing the bitrate are low bitrate stereo extension methods. In a stereo extension method, the stereo audio signal is encoded as a high bitrate mono signal, which is provided by the encoder together with some side information reserved for a stereo extension. In the decoder, the stereo audio signal is then reconstructed from the high bitrate mono signal in a stereo extension making use of the side information. The side information typically takes only a few kbps of the total bitrate.

If a stereo extension scheme aims at operating at low bitrates, an exact replica of the original stereo audio signal cannot be obtained in the decoding process. For the thus required approximation of the original stereo audio signal, an efficient coding model is necessary.

The most commonly used stereo audio coding schemes are Mid Side (MS) stereo and Intensity Stereo (IS).

In MS stereo, the left and right channel signals are transformed into sum and difference signals, as described for example by J. D. Johnston and A. J. Ferreira in "Sum-difference stereo transform coding", ICASSP-92 Conference Record, 1992, pp. 569-572. For a maximum coding efficiency, this transformation is done in both, a frequency and a time dependent manner. MS stereo is especially useful for high quality, high bitrate stereophonic coding.

In the attempt to achieve lower bitrates, IS has been used in combination with this MS coding, where IS constitutes a stereo extension scheme. In IS coding, a portion of the spectrum is coded only in mono mode, and the stereo audio signal is reconstructed by providing in addition different scaling factors for the left and right channels, as described for instance in documents U.S. Pat. No. 5,539,829 and U.S. Pat. No. 5,606,618.

Two further, very low bitrate stereo extension schemes have been proposed with Binaural Cue Coding (BCC) and Bandwidth Extension (BWE). In BCC, described by F. Baumgarte and C. Faller in "Why Binaural Cue Coding is Better than Intensity Stereo Coding, AES112th Convention, May 10-13, 2002, Preprint 5575, the whole spectrum is coded with IS. In BWE coding, described in ISO/IEC JTC1/SC29/WG11 (MPEG-4), "Text of ISO/IEC 14496-3:2001/FPDAM 1, Bandwidth Extension", N5203 (output document from MPEG 62nd meeting), October 2002, a bandwidth extension is used to extend the mono signal to a stereo signal.

Moreover, document U.S. Pat. No. 6,016,473 proposes a low bit-rate spatial coding system for coding a plurality of audio streams representing a soundfield. On the encoder side, the audio streams are divided into a plurality of subband signals, representing a respective frequency subband. Then, a composite signals representing the combination of these subband signals is generated. In addition, a steering control signal is generated, which indicates the principal direction of the soundfield in the subbands, e.g. in form of weighted vectors. On the decoder side, an audio stream in up to two channels is generated based on the composite signal and the associated steering control signal.

SUMMARY OF THE INVENTION

It is an object of the invention to support the extension of a mono audio signal to a multichannel audio signal based on side information in an efficient way.

For the encoding end of a multichannel audio coding system, a first method for supporting a multichannel audio extension is proposed, which comprises transforming a first channel signal of a multichannel audio signal into the frequency domain, resulting in a spectral first channel signal and transforming a second channel signal of this multichannel audio signal into the frequency domain, resulting in a spectral second channel signal. The proposed method further comprises determining for each of a plurality of adjacent frequency bands whether the spectral first channel signal, the spectral second channel signal or none of the spectral channel signals is dominant in the respective frequency band, and providing a corresponding state information for each of the frequency bands.

In addition, a multichannel audio encoder and an extension encoder for a multichannel audio encoder are proposed, which comprise means for realizing the first proposed method.

For the decoding end of a multichannel audio coding system, a second method for supporting a multichannel audio extension is proposed, which comprises transforming a received mono audio signal into the frequency domain, resulting in a spectral mono audio signal. The proposed second method further comprises generating a spectral first channel signal and a spectral second channel signal out of the spectral mono audio signal by weighting the spectral mono audio signal separately in each of a plurality of adjacent frequency bands for each of the spectral first channel signal and the spectral second channel signal based on at least one gain value and in accordance with a received state information. The state information indicates for each of the frequency bands whether the spectral first channel signal, the spectral second channel signal or none of these spectral channel signals is to be dominant within the respective frequency band.

In addition, a multichannel audio decoder and an extension decoder for a multichannel audio decoder are proposed, which comprise means for realizing the second proposed method.

Finally, a multichannel audio coding system is proposed, which comprises as well the proposed multichannel audio encoder as the proposed multichannel audio decoder.

The invention proceeds from the consideration that a stereo extension on a frequency band basis is particularly efficient. The invention proceeds further from the idea that a state information indicating which channel signal is dominant in each frequency band, if any, are particularly suited as side information for extending a mono audio signal to a multichannel audio signal. The state information can be evaluated at a receiving end under consideration of a gain information representing a specific degree of the dominance of channel signals for reconstructing the original stereo signal.

The invention provides an alternative to the known solutions.

It is an advantage of the invention that it supports an efficient multichannel audio coding, which requires at the same time a relatively low computational complexity compared to known multichannel extension solutions.

Also compared to the solution of document U.S. Pat. No. 6,016,473, which is targeted more towards surround coding than stereo or other multichannel audio coding, lower bitrates and less required computations can be expected.

Preferred embodiments of the invention become apparent from the dependent claims.

In a preferred embodiment, at least one gain value representative of the degree of this dominance is calculated and provided by the encoding end, in case it was determined that one of the spectral first channel signal and the spectral second channel signal is dominant in at least one of the frequency bands. Alternatively, at least one gain value could be predetermined and stored at the receiving end.

In the decision which state information should be assigned to a certain frequency band, a binaural psychoacoustical model is suited to provide a useful assistance. Since psychoacoustical models typically require relatively high computational resources, they may take effect in particular in devices in which the computational resources are not very limited.

The spectral first channel signal and the spectral second channel signal generated at the decoding end have to be transformed into the time domain, before they can be presented to a user.

In a first advantageous embodiment, the generated spectral first and second channel signals are transformed at the decoding end directly into the time domain, resulting in a first channel signal and a second channel signal of a reconstructed multichannel audio signal.

Such an embodiment, however, will usually operate at rather low bitrates, e.g. at less than 4 kbps, and for applications in which a higher stereo extension bitrate is available, this embodiment does not scale in quality.

With a second advantageous embodiment, an improved stereo extension can be achieved that is suited to scale both in quality and bitrate. In the second advantageous embodiment, an additional enhancement information is generated on the encoding end, and this additional enhancement information is used at the decoding end in addition for reconstructing the original multichannel audio signal based on the generated spectral first and second channel signals.

For generating the enhancement information at the encoding end, the spectral first channel signal and the spectral second channel signal are reconstructed not only at the decoding end but also at the encoding end based on the state information. The enhancement information is then generated such that it reflects for each spectral sample of those frequency bands, for which the state information indicates that one of the channel signals is dominant, sample-by-sample the difference between the reconstructed spectral first and second channel signals on the one hand and original spectral first and second channel signals on the other hand. It is to be noted that the reflected difference for some of the samples may also consist in an indication that the difference is so minor that it is not considered.

The second advantageous embodiment improves the first advantageous embodiment with only moderate additional complexity and provides a wider operating coverage of the invention. It is an advantage particularly of the second advantageous embodiment that it utilizes already created stereo extension information to obtain a more accurate approximation of the original stereo audio image, without generating extra side information. It is further an advantage particularly of the second advantageous embodiment that it enables a scalability in the sense that the decoding end can decide depending on its resources, e.g. on its memory or on its processing capacities, whether to decode only the base stereo extension bitstream or in addition the enhancement information. In order to enable the encoding end to adjust the amount of the additional enhancement information to the available bitrate, the encoding end preferably provides an information on the bitrate employed for the stereo extension information, i.e. at least the state information, and the additional enhancement information.

The enhancement information can be processed at the encoding end and the decoding end either as well in the extension encoder and decoder, respectively, or in a dedicated additional component.

The multichannel audio signal can be in particular a stereo audio signal having a left channel signal and a right channel signal. In case of more channels, the proposed coding is performed to channel pairs.

The multichannel audio extension enabled by the invention performs best at mid and high frequencies, at which spatial hearing relies mostly on amplitude level differences. For low frequencies, preferably a fine-tuning is realized in addition. Especially the dynamic range of the level modification gain may be limited in this fine-tuning.

The required transformations from the time domain into the frequency domain and from the frequency domain into the time domain can be achieved with different types of transforms, for example with a Modified Discrete Cosine Transform (MDCT) and an Inverse MDCT (IMDCT), with a Fast Fourier Transform (FFT) and an Inverse FFT (IFFT) or with a Discrete Cosine Transform (DCT) and an Inverse DCT (IDCT).

The invention can be used with various codecs, in particular, though not exclusively, with Adaptive Multi-Rate Wideband extension (AMR-WB+), which is suited for high audio quality.

The invention can further be implemented either in software or using a dedicated hardware solution. Since the enabled multichannel audio extension is part of a coding system, it is preferably implemented in the same way as the overall coding system.

The invention can be employed in particular for storage purposes and for transmissions, e.g. to and from mobile terminals.

BRIEF DESCRIPTION OF THE FIGURES

Other objects and features of the present invention will become apparent from the following detailed description of exemplary embodiments of the invention considered in conjunction with the accompanying drawings.

FIG. 5 is an exemplary Huffman table employed in a first possible supplementation of the first embodiment of the invention;

DETAILED DESCRIPTION OF THE INVENTION

Figure 1:
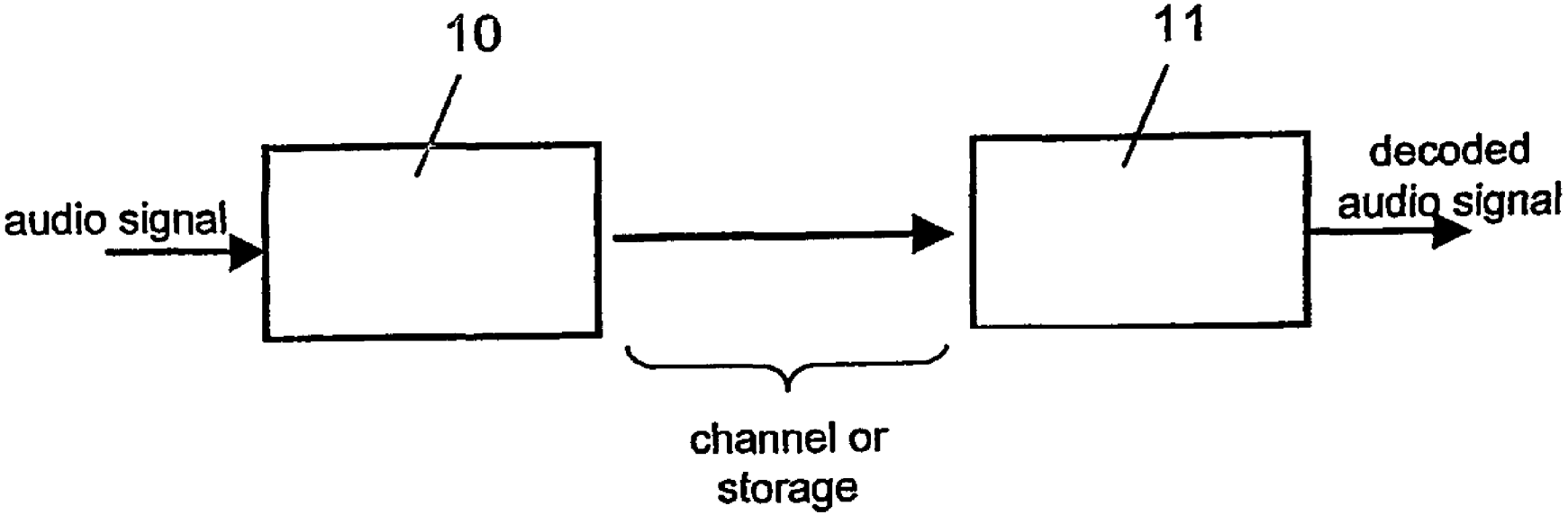
FIG. 1 is a block diagram presenting the general structure of an audio coding system.

FIG. 1 has already been described above.

A first embodiment of the invention will now be described with reference to FIGS. 2 to 6.

Figure 2:
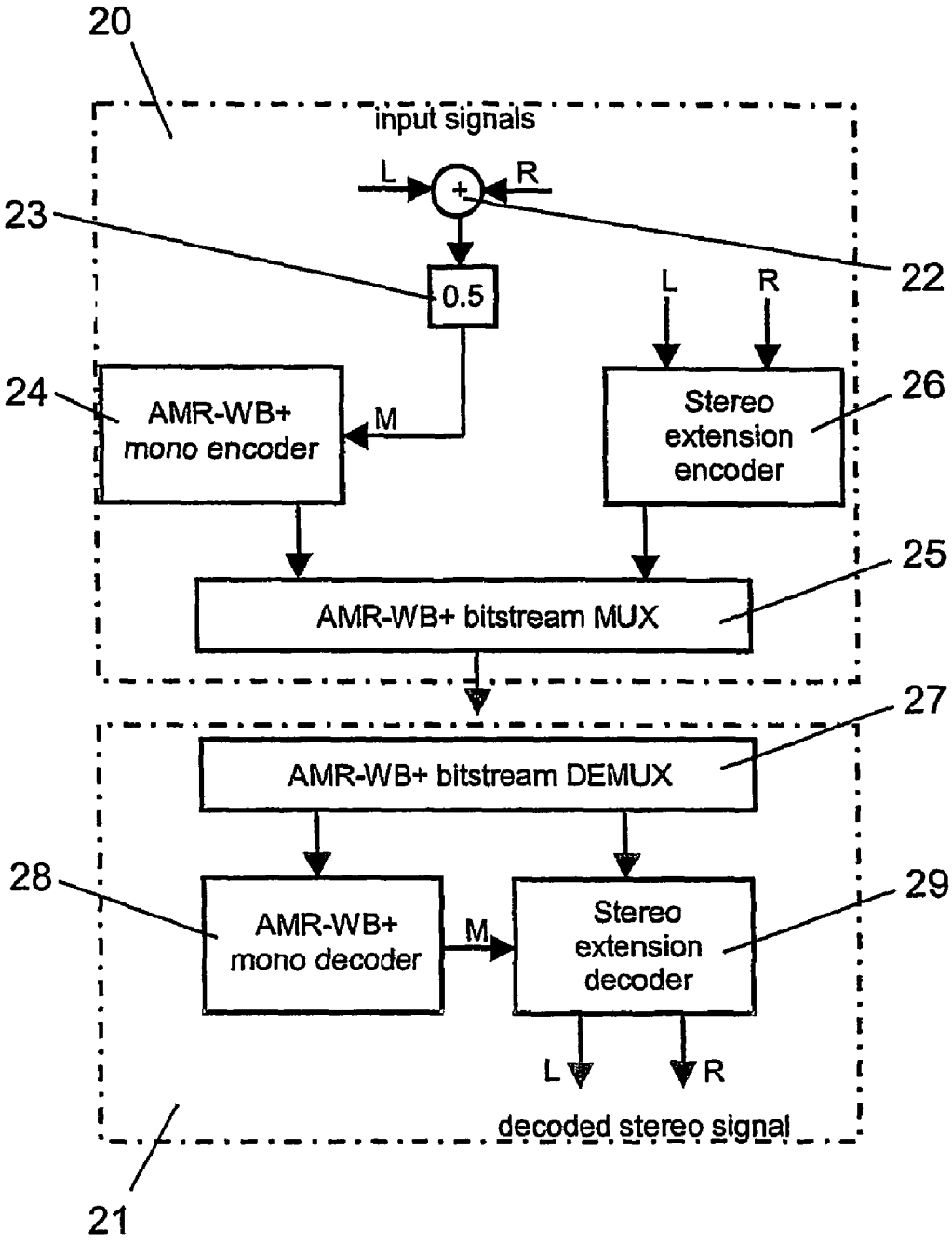
FIG. 2 is a high level block diagram of a stereo audio coding system in which a first embodiment of the invention can be implemented.

FIG. 2 presents the general structure of a stereo audio coding system, in which the invention can be implemented. The stereo audio coding system can be employed for transmitting a stereo audio signal which is composed of a left channel signal and a right channel signal.

The stereo audio coding system of FIG. 2 comprises a stereo encoder 20 and a stereo decoder 21. The stereo encoder 20 encodes stereo audio signals and transmits them to the stereo decoder 21, while the stereo decoder 21 receives the encoded signals, decodes them and makes them available again as stereo audio signals. Alternatively, the encoded stereo audio signals could also be provided by the stereo encoder 20 for storage in a storing unit, from which they can be extracted again by the stereo decoder 21.

The stereo encoder 20 comprises a summing point 22, which is connected via a scaling unit 23 to an AMR-WB+ mono encoder component 24. The AMR-WB+ mono encoder component 24 is further connected to an AMR-WB+ bitstream multiplexer (MUX) 25. In addition, the stereo encoder 20 comprises a stereo extension encoder 26, which is equally connected to the AMR-WB+ bitstream multiplexer 25.

The stereo decoder 21 comprises an AMR-WB+ bitstream demultiplexer (DEMUX) 27, which is connected on the one hand to an AMR-WB+ mono decoder component 28 and on the other hand to a stereo extension decoder 29. The AMR-WB+ mono decoder component 28 is further connected to the stereo extension decoder 29.

When a stereo audio signal is to be transmitted, the left channel signal L and the right channel signal R of the stereo audio signal are provided to the stereo encoder 20. The left channel signal L and the right channel signal R are assumed to be arranged in frames.

The left and right channel signals L, R are summed by the summing point 22 and scaled by a factor 0.5 in the scaling unit 23 to form a mono audio signal M. The AMR-WB+ mono encoder component 24 is then responsible for encoding the mono audio signal in a known manner to obtain a mono signal bitstream.

The left and right channel signals L, R provided to the stereo encoder 20 are processed in addition in the stereo extension encoder 26, in order to obtain a bitstream containing side information for a stereo extension.

The bitstreams provided by the AMR-WB+ mono encoder component 24 and the stereo extension encoder 26 are multiplexed by the AMR-WB+ bitstream multiplexer 25 for transmission.

The transmitted multiplexed bitstream is received by the stereo decoder 21 and demultiplexed by the AMR-WB+ bitstream demultiplexer 27 into a mono signal bitstream and a side information bitstream again. The mono signal bitstream is forwarded to the AMR-WB+ mono decoder component 28 and the side information bitstream is forwarded to the stereo extension decoder 29.

The mono signal bitstream is then decoded in the AMR-WB+ mono decoder component 28 in a known manner. The resulting mono audio signal M is provided to the stereo extension decoder 29. The stereo extension decoder 29 decodes the bitstream containing the side information for the stereo extension and extends the received mono audio signal M based on the obtained side information into a left channel signal L and a right channel signal R. The left and right channel signals L, R are then output by the stereo decoder 21 as reconstructed stereo audio signal.

The stereo extension encoder 26 and the stereo extension decoder 29 are designed according to an embodiment of the invention, as will be explained in the following.

Figure 3:
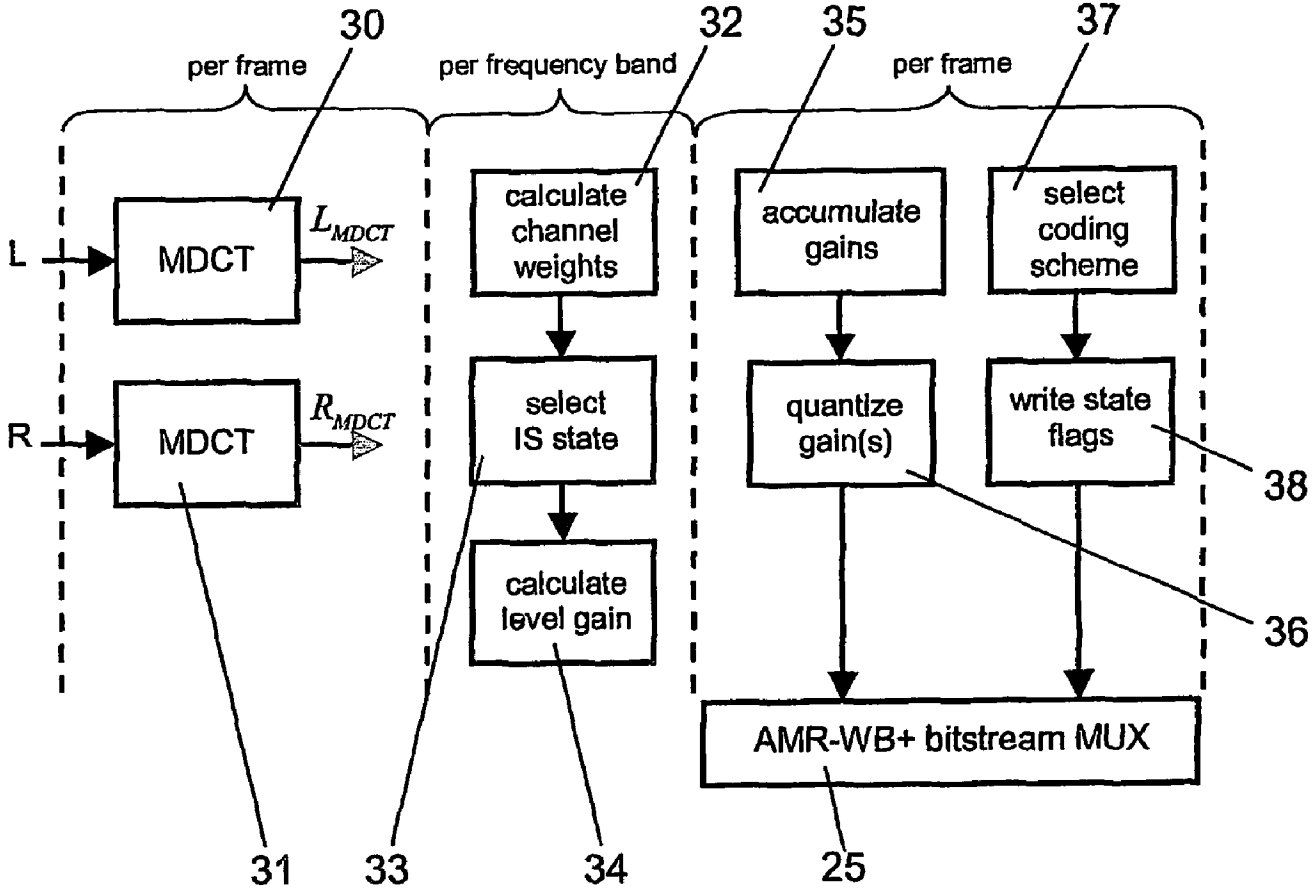
FIG. 3 illustrates the processing on a transmitting side of the stereo audio coding system of FIG. 2 in the first embodiment of the invention.

The processing in the stereo extension encoder 26 is illustrated in more detail in FIG. 3.

The processing in the stereo extension encoder 26 comprises three stages. In a first stage, which is illustrated on the left hand side of FIG. 3, signals are processed per frame. In a second stage, which is illustrated in the middle of FIG. 3, signals are processed per frequency band. In a third stage, which is illustrated on the right hand side of FIG. 3, signals are processed again per frame. In each stage, various processing portions 30-38 are indicated.

In the first stage, a received left channel signal L is transformed by an MDCT portion 30 by means of a frame based-MDCT into the frequency domain, resulting in a spectral channel signal $L_{MDCT}$. In parallel, a received right channel signal R is transformed by an MDCT portion 31 by means of a frame based MDCT into the frequency domain, resulting in a spectral channel signal $R_{MDCT}$. The MDCT has been described in detail e.g. by J. P. Princen, A. B. Bradley in "Analysis/synthesis filter bank design based on time domain aliasing cancellation", IEEE Trans. Acoustics, Speech, and Signal Processing, 1986, Vol. ASSP-34, No. 5, October 1986, pp. 1153-1161, and by S. Shlien in "The modulated lapped transform, its time-varying forms, and its applications to audio coding standards", IEEE Trans. Speech, and Audio Processing, Vol. 5, No. 4, July 1997, pp. 359-366.

In the second stage, the spectral channel signals $L_{MDCT}$ and $R_{MDCT}$ are processed within the current frame in several adjacent frequency bands. The frequency bands follow the boundaries of critical bands, as explained in detail by E. Zwicker, H. Fastl in "Psychoacoustics, Facts and Models", Springer-Verlag, 1990. For example, for coding of mid frequencies from 750 Hz to 6 kHz at a sample rate of 24 kHz, the widths IS_WidthLenBuf [ ] in samples of the frequency bands for a total number of frequency bands numTotalBands of 27 are as follows:

IS_WidthLenBuf [ ]={3, 3, 3, 3, 3, 3, 3, 4, 4, 5, 5, 5, 6, 6, 7, 7, 8, 9, 9, 10, 11, 14, 14, 15, 15, 17, 18}.

First, a processing portion 32 computes channel weights for each frequency band for the spectral channel signals $L_{MDCT}$ and $R_{MDCT}$, in order to determine the respective influence of the left and right channel signals L and R in the original stereo audio signal in each frequency band.

The two channels weights for each frequency band are computed according to the following equations:

$$\begin{cases} g_L(fband) = \sqrt{\dfrac{E_L}{E_L + E_R}} \\ g_R(fband) = \sqrt{\dfrac{E_R}{E_L + E_R}} \end{cases} \quad fband = 0, \ldots, numTotalBands - 1 \tag{1}$$

with $$E_L = \sum_{i=0}^{IS_WidthLenBuf[fband]-1} L_{MDCT}(n+i)^2$$

$$E_R = \sum_{i=0}^{IS_WidthLenBuf[fband]-1} R_{MDCT}(n+i)^2,$$

where fband is a number associated to the respectively considered frequency band, and where n is the offset in spectral samples to the start of this frequency band fband. That is, the intermediate values $E_L$ and $E_R$ represent the sum of the squared level of each spectral sample in a respective frequency band and a respective spectral channel signal.

In a subsequent processing portion 33, to each frequency band one of the states LEFT, RIGHT and CENTER is assigned. The LEFT state indicates a dominance of the left channel signal in the respective frequency band, the RIGHT state indicates a dominance of the right channel signal in the respective frequency band, and the CENTER state represents mono audio signals in the respective frequency band. The assigned states are represented by a respective state flag IS_flag (fband) which is generated for each frequency band.

The state flags are generated more specifically based on the following equation:

$$\text{IS_flag}(fband) = \begin{cases} \text{LEFT}, & \text{if } A \text{ and } gL_{ratio} > \text{threshold} \\ \text{RIGHT}, & \text{if } B \text{ and } gR_{ratio} > \text{threshold} \\ \text{CENTER}, & \text{otherwise} \end{cases} \tag{2}$$

with $A = g_L(fband) > g_R(fband)$ $B = g_R(fband) > g_L(fband)$ $gL_{ratio} = g_L(fband)/g_R(fband)$ $gR_{ratio} = g_R(fband)/g_L(fband)$ The parameter threshold in equation (2) determines how good the reconstruction of the stereo image should be. In the current embodiment, the value of the parameter threshold is set to 1.5. Thus, if the weight of one of the spectral channels does not exceed the weight of the respective other one of the spectral channels by at least 50%, the state flag represents the CENTER state.

In case the state flag represents a LEFT state or a RIGHT state, in addition level modification gains are calculated in a subsequent processing portion 34. The level modification gains allow a reconstruction of the stereo audio signal within the frequency bands when proceeding from the mono audio signal M.

The level modification gain $g_{LR}$(fband) is calculated for each frequency band fband according to the equation:

$$g_{LR}(fband) = \begin{cases} 0, 0, & \text{if IS_flag}(fband) = \text{CENTER} \\ gL_{ratio} & \text{if IS_flag}(fband) = \text{LEFT} \\ gR_{ratio}, & \text{otherwise} \end{cases} \tag{3}$$

In the third stage, the generated level modification gains $g_{LR}$(fband) and the generated stage flags IS_flag(fband) are further processed on a frame basis for transmission.

The level modification gains can be transmitted for each frequency band or only once per frame. If only a common gain value is to be transmitted for all frequency bands, the common level modification gain $g_{LR_average}$ is calculated in processing portion 35 for each frame according to the equation:

$$g_{LR_average} = \sqrt{\frac{1}{N} \cdot \sum_{i=0}^{numTotalBands-1} g_{LR}(i)} \tag{4}$$

with

-continued $$N = \sum_{i=0}^{numTotalBands-1} \begin{cases} 1, & \text{if IS_flag}(i) \neq \text{CENTER} \\ 0 & \text{otherwise} \end{cases}$$

Thus, the common level modification gain $g_{LR_average}$ constitutes the average of all frequency band associated level modification gains $g_{LR}$(fband) which are no equal to zero.

Processing portion 36 then quantizes the common level modification gain $g_{LR_average}$ or the dedicated level modification gains $g_{LR}$(fband) using scalar or, preferably, vector quantization techniques. The quantized gain or gains are coded into a bit sequence and provided as a first part of a side information bitstream to the AMR-WB+ bitstream multiplexer 25 of the stereo encoder 20 of FIG. 2. In the presented embodiment, the gain is coded using 5 bits, but this value can be changed depending on how coarsely the gain(s) is (are) to be quantized.

For coding the state flags for transmission, a coding scheme is selected in processing portion 37 for each frame, in order to minimize the bit consumption with a maximum efficiency.

More specifically, three coding schemes are defined for selection. The coding scheme indicates which state appears most frequently within the frame and is selected according to the following equation:

$$\min_{j=0,1,2} \left\{ \sum_{i=0}^{numTotalBands-1} \begin{cases} 1, & \text{if IS_flag}(i) = codingScheme(j) \\ 2, & \text{otherwise} \end{cases} \right\} \quad (5)$$

with $$codingScheme = \{\text{CENTER, LEFT, RIGHT}\}$$

Thus, a CENTER coding scheme is selected in case the CENTER state appears most frequently within a frame, a LEFT coding scheme is selected in case the LEFT state appears most frequently within a frame, and a RIGHT coding scheme is selected in case the RIGHT state appears most frequently within a frame. The selected coding scheme itself is coded by two bits.

Processing portion 37 codes the state flags according the coding scheme selected in processing portion 36.

In each of the coding schemes, the state which appears most frequently is coded in a respective first bit, while the remaining two states are coded in an eventual second bit.

In case the CENTER coding scheme was selected and in case the CENTER state was also assigned to a specific frequency band, a '1' is provided as first bit for this specific frequency band, otherwise a '0' is provided as first bit. In the latter case, a '0' is provided as second bit, if the LEFT state was assigned to this specific frequency band, and a '1' is provided as second bit, if the RIGHT state was assigned to this specific frequency band.

In case the LEFT coding scheme was selected and in case the LEFT state was also assigned to a specific frequency band, a '1' is provided as first bit for this specific frequency band, otherwise, a '0' is provided as first bit. In the latter case, a '0' is provided as second bit, if the RIGHT state was assigned to this specific frequency band, and a '1' is provided as second bit, if the CENTER state was assigned to this specific frequency band.

Finally, in case the RIGHT coding scheme was selected and in case the RIGHT state was also assigned to a specific frequency band, a '1' is provided as first bit for this specific frequency band, otherwise, a '0' is provided as first bit. In the latter case, a '0' is provided as second bit, if the CENTER state was assigned to this specific frequency band, and a '1' is provided as second bit, if the LEFT state was assigned to this specific frequency band.

The 2-bit indication of the coding scheme and the coded state flags for all frequency bands are provided as a second part of a side information bitstream to the AMR-WB+ bitstream multiplexer 25 of the stereo encoder 20 of FIG. 2.

The AMR-WB+ bitstream multiplexer 25 multiplexes the received side information bitstream with the mono signal bitstream for transmission, as described above with reference to FIG. 2.

The transmitted signal is received by the stereo decoder 21 of FIG. 2 and processed by the AMR-WB+ bitstream demultiplexer 27 and the AMR-WB+ mono decoder component 28 as described above.

Figure 4:
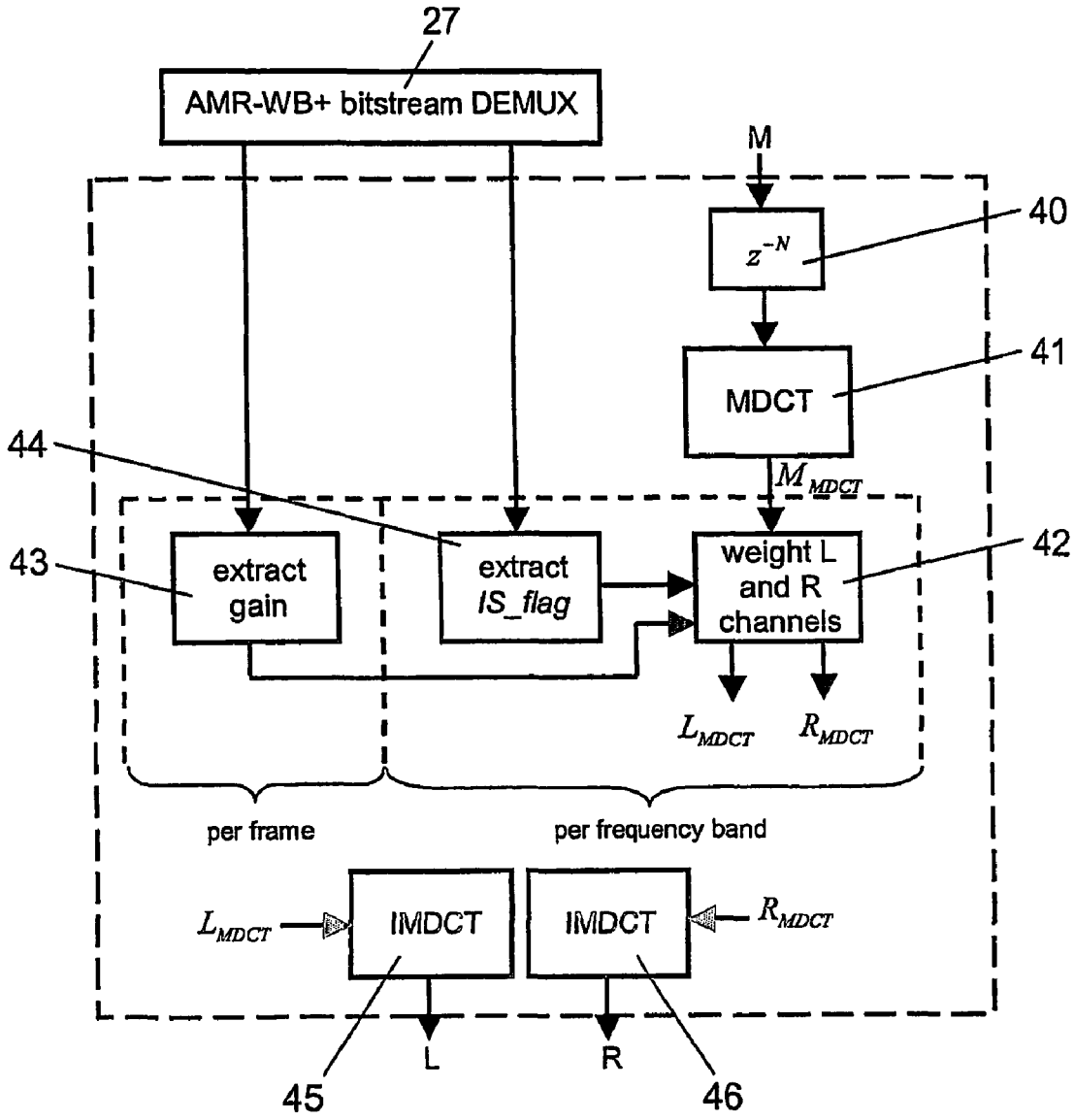
FIG. 4 illustrates the processing on a receiving side of the stereo audio coding system of FIG. 2 in the first embodiment of the invention.

The processing in the stereo extension decoder 29 of the stereo decoder 21 of FIG. 2 is illustrated in more detail in FIG. 4. FIG. 4 is a schematic block diagram of the stereo extension decoder 29.

The stereo extension decoder 29 comprises a delaying portion 40, which is connected via an MDCT portion 41 to a weighting portion 42. The stereo extension decoder 29 further comprises a gain extraction portion 43 and an IS_flag extraction portion 44, an output of both being connected to an input of the weighting portion 42. The weighting portion 42 has two outputs, each one connected to the input of another IMDCT portion 45, 46. The latter two connections are not depicted explicitly, but indicated by corresponding arrows.

A mono audio signal M output by the AMR-WB+ mono decoder component 28 of the stereo decoder 21 of FIG. 2 is first fed to the delaying portion 40, since the mono audio signal M may have to be delayed if the decoded mono audio signal is not time-aligned with the encoder input signal.

Then, the mono audio signal is transformed by the MDCT portion 41 into the frequency domain by means of a frame based MDCT. The resulting spectral mono audio signal $M_{MDCT}$ is fed to the weighting portion 42.

At the same time, the AMR-WB+ bitstream demultiplexer 27 of FIG. 2, which is also indicated in FIG. 4, provides the first portion of the side information bitstream to the gain extraction portion 43 and the second portion of the side information bitstream to the IS_flag extraction portion 44.

The gain extraction portion 43 extracts for each frame the common level modification gain or the dedicated level modification gains from the first part of the side information bitstream, and decodes the extracted gain or gains. The decoded gain $g_{LR_average}$ is or the decoded gains $g_{LR}$ (fband) are provided to the weighting portion 42.

The IS_flag extraction portion 44 extracts and decodes for each frame the indication of the coding scheme and the state flags IS_flag(fband) from the second part of the side information bitstream.

Decoding of the state flags is performed such that for each frequency band, first only one bit is read. In case this bit is equal to '1', the state represented by the indicated coding scheme is assigned to the respective frequency band. In case the first bit is equal to '0', a second bit is read and the correct state is assigned to the respective frequency band depending on this second bit.

If the CENTER coding scheme is indicated, the state flags are set as follows depending on the last read bit:

$$\text{IS_flag}(fband) = \begin{cases} \text{CENTER}, & BsGetBits(1) = 1 \\ \text{LEFT}, & BsGetBits(2) = 0 \\ \text{RIGHT}, & BsGetBits(2) = 1 \end{cases} \quad (6)$$

If the LEFT coding scheme is indicated, the state flags are set as follows depending on the last read bit:

$$\text{IS_flag}(fband) = \begin{cases} \text{CENTER}, & BsGetBits(2) = 1 \\ \text{LEFT}, & BsGetBits(1) = 1 \\ \text{RIGHT}, & BsGetBits(2) = 0 \end{cases} \quad (7)$$

And finally, if RIGHT coding scheme is indicated, the state flags are set as follows depending on the last read bit:

$$\text{IS_flag}(fband) = \begin{cases} \text{CENTER}, & BsGetBits(2) = 0 \\ \text{LEFT}, & BsGetBits(2) = 1 \\ \text{RIGHT}, & BsGetBits(1) = 1 \end{cases} \quad (8)$$

In the above equations (6) to (8), the function BsGetBits(x) reads x bits from an input bitstream buffer.

For each frequency-band, the resulting state flag IS_flag (fband) is provided to the weighting portion 42.

Based on the received level modification gain or gains and the received state flags, the spectral mono audio signal $M_{MDCT}$ is extended in the weighting portion 42 to spectral left and right channel signals.

The spectral left and right channel signals are obtained from the spectral mono audio signal $M_{MDCT}$ according to the following equations:

$$L_{MDCT}(n) = \begin{cases} g_{LR}(fband) \cdot M_{MDCT}(n), & \text{if IS_flag}(fband) = \text{LEFT} \\ 1/g_{LR}(fband) \cdot M_{MDCT}(n), & \text{if IS_flag}(fband) = \text{RIGHT} \\ M_{MDCT}(n), & \text{otherwise} \end{cases} \quad (9)$$

$$R_{MDCT}(n) = \begin{cases} g_{LR}(fband) \cdot M_{MDCT}(n), & \text{if IS_flag}(fband) = \text{RIGHT} \\ 1/g_{LR}(fband) \cdot M_{MDCT}(n), & \text{if IS_flag}(fband) = \text{LEFT} \\ M_{MDCT}(n), & \text{otherwise} \end{cases} \quad (10)$$

Equations (9) and (10) operate on a frequency band basis. For each frequency band associated to the number fband, a respective state flag IS_flag indicates to the weighting portion 42 whether the spectral mono audio signal samples $M_{MDCT}$ (n) within the frequency band originate mainly from the original left or the original right channel signal. The level modification gain $g_{LR}$(fband) represents the degree of the dominance of the left or the right channel signal in the original stereo audio signal, if any, and is used for reconstructing the stereo image within each frequency band. To this end, the level modification gain is multiplied to the spectral mono audio signal samples for obtaining samples for the dominant channel signal and the reciprocal value of the level modification gain is multiplied to the spectral mono audio signal samples for obtaining samples for the respective other channel. It is to be noted that this reciprocal value may also be weighted by a fixed or a variable value. The reciprocal value in equations (9) and (10) it may be substituted for instance by $1/(\sqrt{g_{LR}(\text{fband})} \cdot g_{LR}(\text{fband}))$. In case none of the channel signals was dominant in a specific frequency band, the spectral mono audio signal samples within this frequency band are used directly as samples for both spectra channel signals within this frequency band.

The entire spectral left channel signal within a specific frequency band is composed of all sample values $L_{MDCT}$(n) determined for this specific frequency band. Equally, the entire spectral right channel signal within a specific frequency band is composed of all sample values $R_{MDCT}$(n) determined for this specific frequency band.

In case a common level modification gain is used, the gain $g_{LR}$(fband) in equations (9) and (10) is the equal to this common value $g_{LR_average}$ for all frequency bands.

If multiple level modification gains are used within the frame, i.e. if a dedicated level modification gain is provided for each frequency band, a smoothing of the gains is performed at the boundaries of the frequency bands. Smoothing at the start of a frame is performed according to the following two equations:

$$L_{MDCT}(n) = \begin{cases} g_{start} \cdot M_{MDCT}(n), & \text{if IS_flag}(fband) = \text{LEFT} \\ 1/g_{start} \cdot M_{MDCT}(n), & \text{if IS_flag}(fband) = \text{RIGHT} \\ M_{MDCT}(n), & \text{otherwise} \end{cases} \quad (11)$$

$$R_{MDCT}(n) = \begin{cases} g_{start} \cdot M_{MDCT}(n), & \text{if IS_flag}(fband) = \text{RIGHT} \\ 1/g_{start} \cdot M_{MDCT}(n), & \text{if IS_flag}(fband) = \text{LEFT} \\ M_{MDCT}(n), & \text{otherwise} \end{cases} \quad (12)$$

where $gs = (g_{LR}(\text{fband}-1) + g_{LR}(\text{fband}))/2$.

Smoothing at the end of a frame is performed according to the following two equations:

$$L_{MDCT}(n) = \begin{cases} g_{end} \cdot M_{MDCT}(n), & \text{if IS_flag}(fband) = \text{LEFT} \\ 1/g_{end} \cdot M_{MDCT}(n), & \text{if IS_flag}(fband) = \text{RIGHT} \\ M_{MDCT}(n), & \text{otherwise} \end{cases} \quad (13)$$

$$R_{MDCT}(n) = \begin{cases} g_{end} \cdot M_{MDCT}(n), & \text{if IS_flag}(fband) = \text{RIGHT} \\ 1/g_{end} \cdot M_{MDCT}(n), & \text{if IS_flag}(fband) = \text{LEFT} \\ M_{MDCT}(n), & \text{otherwise} \end{cases} \quad (14)$$

where $g_{end} = [g_{LR}(\text{fband}) + g_{LR}(\text{fband}+1)]/2$.

The smoothing is performed only for a few samples at the start and the end of the frequency band. The width of the smoothing region increases with the frequency. For example, in case of 27 frequency band, in the first 16 frequency bands, the first and the last spectral sample may be smoothed. For the next 5 frequency bands, the smoothing may be applied to the first and the last 2 spectral samples. For the remaining frequency bands, the first and the last 4 spectral samples may be smoothed.

Finally, the left channel signal $L_{MDCT}$ is transformed into the time domain by means of a frame based IMDCT by the IMDCT portion 45, in order to obtain the restored left channel signal L, which is then output by the stereo decoder 21. The right channel signal $R_{MDCT}$ is transformed into the time domain by means of a frame based IMDCT by the IMDCT portion 46, in order to obtain the restored right channel signal R, which is equally output by the stereo decoder 21.

In some special situations, the states assigned to the frequency bands could be communicated to the decoder even more efficiently than described above, as will be explained for two examples in the following.

In the above presented exemplary embodiment, two bits are reserved for communicating the employed coding scheme. CENTER ('00'), LEFT ('01') and RIGHT ('10') schemes, however, occupy only three of the four possible values that can be signaled with two bits. The remaining value ('11') can thus be used for coding highly correlated stereo audio frames. In these frames, the CENTER, LEFT, and RIGHT states of the previous frame are used also for the current frame. This way, only the above mentioned two signaling bits indicating the coding scheme have to be transmitted for the entire frame, i.e. no additional bits are transmitted for a state flag for each frequency band of the current frame.

Furthermore, depending on the strength of the stereo image, occasionally only few LEFT and/or RIGHT states may appear within the current coding frame, that is, the CENTER state is assigned to almost all frequency bands. In order to achieve an efficient coding of these so-called sparsely populated LEFT and RIGHT states, an entropy coding of the CENTER, LEFT, and RIGHT states may be beneficial. In an entropy coding, the CENTER states are regarded as zero-valued bands, which are entropy coded, for example with Huffman codewords. A Huffman codeword describes the run of zeros, that is, the run of successive CENTER states, and each Huffman codeword is followed by one bit indicating whether a LEFT or a RIGHT state follows the run of successive CENTER states. The LEFT state can be signaled, for example, with a value '1' and the RIGHT state with a value '0' of the one bit. The signaling can also be vice versa, as long as both, the encoder and the decoder know the coding convention.

An example of a Huffman table that could be employed for obtaining Huffman codewords is presented in FIG. 5.

The table shown in FIG. 5 comprises a first column indicating the count of consecutive zeros, a second column describing the number of bits used for the corresponding Huffman codeword, and a third column presenting the actual Huffman codeword to be used for the respective run of zeros. The table assigns Huffman codewords for counts of zeros from no zeros up to 26 zeros. The last row, which is associated to a theoretical count of 27 zeros, is used for the cases when the rest of the states in a frame are CENTER states only.

A first example of sparsely populated LEFT and/or RIGHT states which is coded based on the Huffman table of FIG. 5 is presented below.

$$\underbrace{CCC}_{3}L\underbrace{CCC}_{3}R\underbrace{C}_{1}R$$

In the above sequence, C stands for CENTER state, L for LEFT state and R for RIGHT state. In the proposed entropy coding, first, three CENTER states are Huffman coded, resulting in a 4-bit codeword having the value 9, which is followed by one bit having the value '1' representing a LEFT state. Next, again three CENTER states are Huffman coded, resulting in a 4-bit codeword having the value 9, which is followed by one bit having the value '0' representing a RIGHT state. Finally, one CENTER state is Huffman coded, resulting in a 3-bit codeword having the value 7, which is followed by one bit having the value '0' representing again a RIGHT state.

A second example of sparsely populated LEFT and/or RIGHT states is presented below.

$$\underbrace{CCC}_{3}L\underbrace{CCC}_{3}R\underbrace{CC}_{2}$$

In the proposed entropy coding, first three CENTER states are Huffman coded, resulting in a 4-bit codeword having the value 9, which is followed by one bit having the value '1'. Next, again three CENTER states are Huffman coded, resulting in a 4-bit codeword having the value 9, which is followed by one bit having the value '0' bit. Finally a special Huffman symbol is used to indicate that the rest of states in the frame are CENTER states, in this case two CENTER states. According to the table of FIG. 5, this special symbol is a 4-bit codeword having the value 12.

In the most efficient implementation of the stereo audio coding system presented with reference to FIGS. 2 to 4, the bit consumption of all presented coding methods is checked and the method that results in the minimum bit consumption is selected for communicating the required states. One extra signaling bit has to be transmitted for each frame from the stereo encoder 20 to the stereo decoder 21, in order to separate the two-bit coding scheme from the entropy coding scheme. For example, a value of '0' of the extra signaling bit can indicate that the two-bit coding scheme will follow, and a value of '1' of the extra signaling bit can indicate that entropy coding will be used.

In the following, a further possible supplementation of the exemplary embodiment of the invention presented above with reference to FIGS. 2 to 4.

The embodiment of the invention presented above may be based on the transmission of an average gain for each frame, which average gain is determined according to equation (4). An average gain, however, represents only the spatial strength within the frame and basically discards any differences between the frequency bands within the frame. If large spatial differences are present between the frequency bands, at least the most significant bands should be considered separately. To this end, multiple gains may have to be transmitted within the frame basically at any time instant.

A coding scheme will now be presented, which allows to achieve an adaptive allocation of the gains not only between the frames, but equally between the frequency bands within the frame.

At the transmitting side, the stereo extension encoder 26 of the stereo encoder 20 first determines and quantizes the average gain $g_{LR_average}$ for a respective frame as explained above with reference to equation (4) and with reference to processing portions 35 and 36. The average gain $g_{LR_average}$ is also transmitted as described above. In addition, however, the average gain $g_{LR_average}$ is compared to the gain $g_{LR}$(fband) calculated for each frequency band, and for each band a decision is made whether the gain in the respective band is considered to be significant based on the following equation:

$$\text{gain_flag}(fband) = \begin{cases} \text{significant} & \text{if } a = \text{TRUE} \\ \text{insignificant} & \text{otherwise or if IS_FLAG}(fband) = \text{CENTER} \end{cases} \quad (15)$$

with $$a = \begin{cases} \text{TRUE}, & \text{if } gRatio(fband) < 0.75 \text{ or } gRatio(fband) > 1.25 \\ \text{FALSE}, & \text{otherwise} \end{cases}$$

and with $$gRatio(fband) = \frac{\sqrt{g_{LR}(fband)}}{Q[g_{LR_average}]},$$

where Q[ ] represents a quantization operator and where 0≦fband<numTotalBands. Thus, the flag gain_flag(fband) indicates for each frequency band whether a gain and the associated frequency band is significant or not. It is to be noted that the gain of the frequency bands which are assigned to the CENTER state are always considered to be insignificant.

Now, the number of bands that are determined to be significant are counted. If zero bands are determined to be significant, a bit having the value '0' is transmitted to indicate that no further gain information will follow.

If more than zero bands are determined to be significant, a bit having the value '1' is transmitted to indicate that further gain information will follow.

Figure 6:
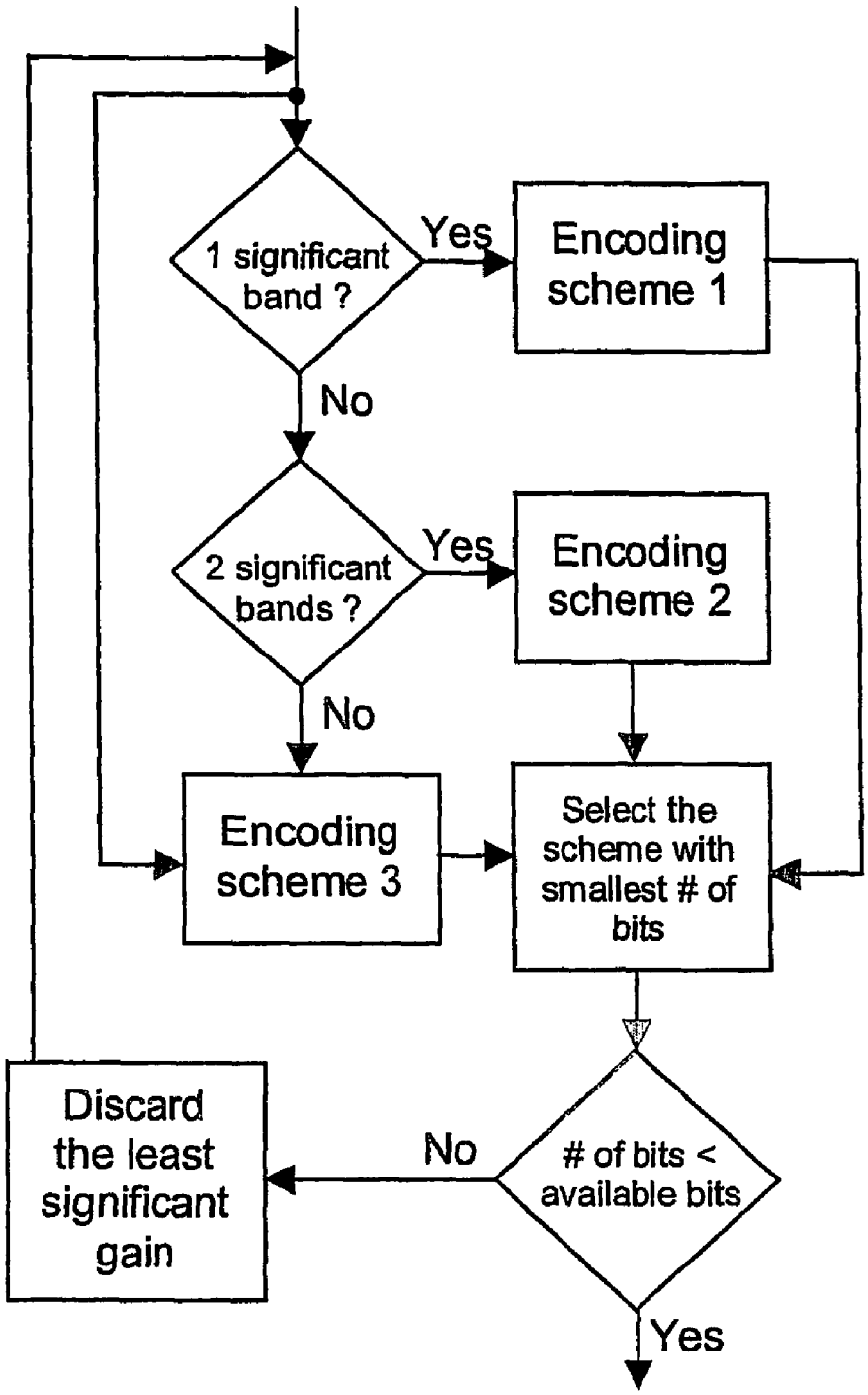
FIG. 6 is a flow chart illustrating a second possible supplementation of the embodiment of the first invention.

FIG. 6 is a flow chart illustrating the further steps in the stereo extension encoder 26 for the case at least one significant band was found.

If exactly one frequency band is determined to be significant, a first encoding scheme is selected. In this encoding scheme, a second bit having the value '1' is provided for transmission to indicate that information about one significant gain will follow. Additional two bits are provided for signaling an index indicating where the significant gain is located within the gain_flags. When locating a gain, CENTER states are excluded to achieve the most efficient coding of the index. In case the value of the resulting index is larger than what can be represented with two bits, an escape coding of three bits is used. Escape coding is thus always triggered when the value of the index is equal or larger than 3. Typically, the distribution of the index is below 3 so that escape coding is used rarely. The determined gain related value gRatio which is associated to the identified significant frequency band is then quantized by vector quantization. Five bits are provided for transmission of a codebook index corresponding to the quantization result.

If two or more frequency bands are determined to be significant, a second bit having the value '0' is provided for transmission to indicate that information about two or more significant gains will follow.

If two frequency bands are determined to be significant, a second encoding scheme is selected. In this second encoding scheme, next a bit having the value '1' is provided for transmission to indicate that only information about two significant gains will follow. The first significant gain is localized within the gain_flags and associated to a first index, which is coded with two bits. Three bits are used again for a possible escape coding. The second significant gain is also localized within the gain_flags and associated to a second index, which is coded with three bits, and for the possible escape coding again three bits are used. The determined gain related values gRatio which are associated to the identified significant frequency bands are quantized by vector quantization. Five bits, respectively, are provided for transmission of a codebook index corresponding to the quantization result.

If three or more frequency bands are determined to be significant, a third encoding scheme is selected. In this third encoding scheme, next a bit having the value '0' is provided for transmission to indicate that information about at least three significant gains will follow. For each LEFT or RIGHT state frequency band, then one bit is provided for transmission to indicate whether the respective frequency band is significant or not. A bit having the value '0' is used to indicate that the band is insignificant and a bit having the value '1' is used to indicate that the band is significant. In case a frequency band is significant, the gain related values gRatio which is associated to this frequency band is quantized by a vector quantization resulting in five bits. Five bits, respectively, are provided for transmission of a codebook index corresponding to the quantization result in sequence with the respective one bit indicating that the frequency band is significant.

Before the actual transmission of the bits provided in accordance with one of the three encoding schemes, it is first determined whether the third encoding scheme would result in a lower bit consumption than the first or the second encoding scheme, in case only one or two significant bands are present. It is possible that in some cases, for example due to escape coding, the third encoding scheme provides a more efficient bit usage even though only one or two significant bands are present. To achieve the maximum coding efficiency, the respective encoding scheme which results in the lowest bit consumption is selected for providing the bits for the actual transmission.

In addition, it is also determined whether the number of bits that are to be transmitted is smaller than the number of available bits. If this is not the case, the least significant gain is discarded and the determination of the bits that are to be transmitted is started anew as described above.

The least significant gain is determined to this end as follows. First, the gRatio values are mapped to the same signal level. As can be seen from equation (15), gRatio(fband) can be either below or above value 1. The mapping is done such that the reciprocal value of gRatio(fband) is taken, if the value of gRatio(fband) is below 1, otherwise the value of gRatio (fband) is taken, as indicated in the following equation:

$$gRatioNew(fband) = \begin{cases} gRatio(fband), & \text{if } gRatio > 1 \\ 1/gRatio(fband), & \text{otherwise} \end{cases} \quad (16)$$

Equation (16) is repeated for 0≦fband<numTotalBands, but only for those frequency bands which were marked to be significant. Next, gRatioNew is sorted in the order of decreasing importance, that is, the first item in gRatioNew is the largest value, the second item in gRatioNew is the second largest value, and so on. The least significant gain is the smallest value in the sorted gRatioNew. The frequency band corresponding to this value is then marked as insignificant.

At the receiving side, more specifically in the gain extraction portion 43 of the encoder 21, first, the average gain value is read as described above. Then, one bit is read to check whether any significant gain is present. In case the first bit is equal to '0', no significant gain is present, otherwise at least one significant gain is present.

In case at least one significant gain is present, the gain extraction portion 43 then reads a second bit to check whether only one significant gain is present.

If the second bit has a value of '1', the gain extraction portion 43 knows that only one significant gain is present and reads two further bits in order to determine the index and thus the location of the significant gain. If the index has a value of 3, three escape coding bits are read. The index is inverse mapped to the correct frequency band index by excluding the CENTER states. Finally, five bits are read for obtaining the codebook index of the quantized gain related value gRatio, If the second read bit has a value of '0', the gain extraction portion 43 knows that two or more significant gains are present, and reads a third bit.

If the third read bit has a value of '1', the gain extraction portion 43 knows that only two significant gains are present. In this case, two further bits are read in order to determine the index and thus the location of the first significant gain. If the first index has a value of 3, three escape coding bits are read. Next, three bits are read to decoded the second index and thus the location of the second significant gain. If the second index has a value of 7, three escape coding bits are read. The indices are inverse mapped to the correct frequency band indices by excluding the CENTER states. Finally, five bits are read for the codebook indices of the first and second quantized gain related value gRatio, respectively.

If the third read bit has a value of '0', the gain extraction portion 43 knows that three or more significant gains are present. In this case, one further bit is read for each LEFT or RIGHT state frequency band. If the respective further read bit has a value of '1', the decoder knows that the frequency band is significant and additional five bits are read immediately after the respective further bit, in order to obtain the codebook index to decode the quantized gain related value gRatio of the associated frequency band. If the respective further read bit has a value of '0', no additional bits are read for the respective frequency band.

The gain for each frequency band is finally reconstructed according to the following equation:

$$g_{LR}(fband) = \begin{cases} Q[g_{LR_average}] \cdot gRatio(fband), & \text{if gain_flag}(fband) = \text{significant} \\ Q[g_{LR_average}], & \text{otherwise} \end{cases} \quad (17)$$

where $Q\lfloor g_{LR_average} \rfloor$ represents the transmitted average gain. Equation (17) is repeated for $0 \leqq fband < numTotalBands$.

A second embodiment of the invention, which proceeds from the first presented embodiment, will now be described with reference to FIGS. 7 to 11.

Figure 7:
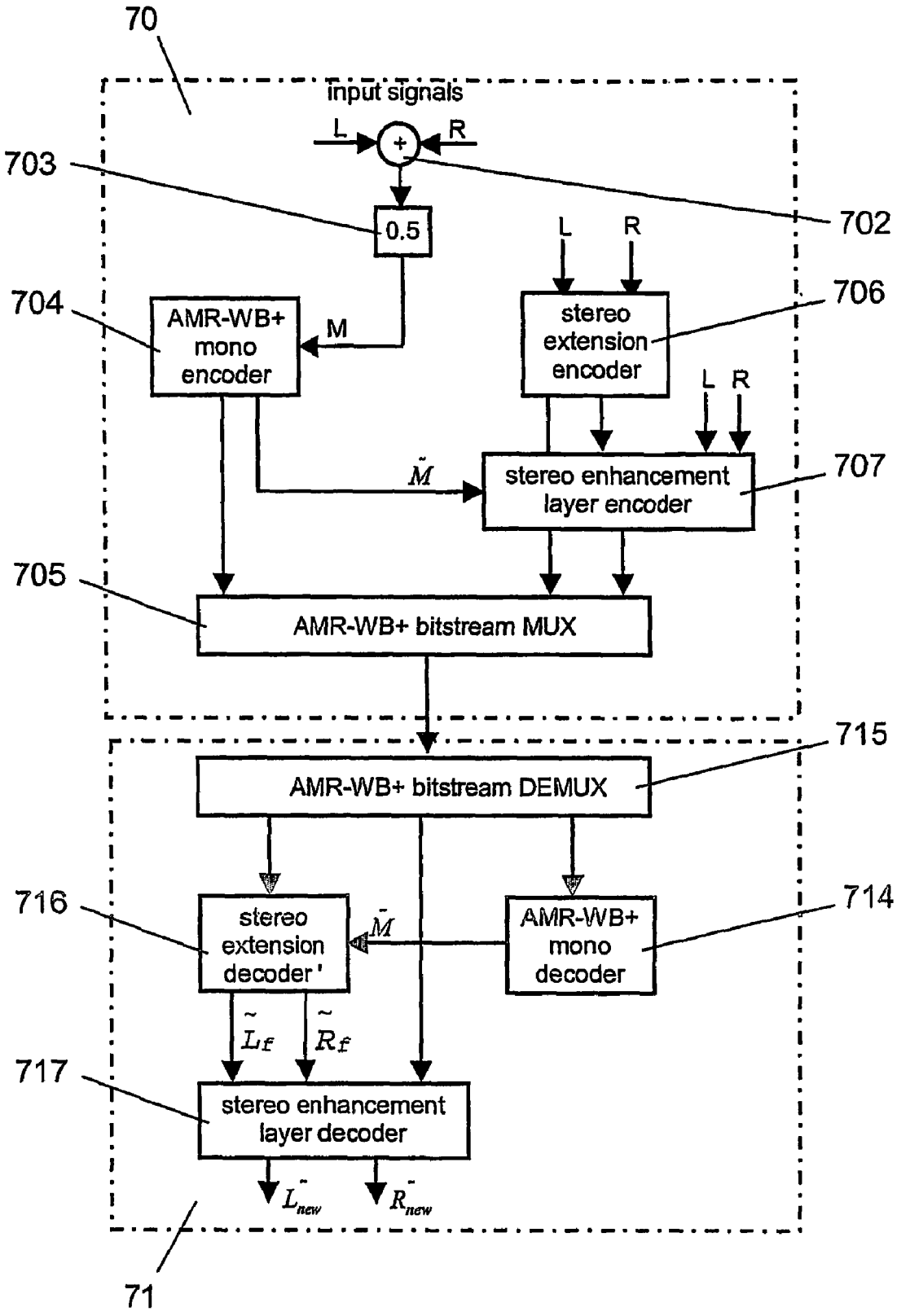
FIG. 7 is a high level block diagram of a stereo audio coding system in which a second embodiment of the invention can be implemented.

FIG. 7 presents the general structure of a stereo audio coding system, in which the second embodiment of the invention can be implemented. This stereo audio coding system can be employed as well for transmitting a stereo audio signal which is composed of a left channel signal and a right channel signal.

The stereo audio coding system of FIG. 7 comprises again a stereo encoder 70 and a stereo decoder 71. The stereo encoder 70 encodes stereo audio signals and transmits them to the stereo decoder 71, while the stereo decoder 71 receives the encoded signals, decodes them and makes them available again as stereo audio signals. Alternatively, the encoded stereo audio signals could also be provided by the stereo encoder 70 for storage in a storing unit, from which they can be extracted again by the stereo decoder 71.

The stereo encoder 70 comprises a summing point 702, which is connected via a scaling unit 703 to an AMR-WB+ mono encoder component 704. The AMR-WB+ mono encoder component 704 is further connected to an AMR-WB+ bitstream multiplexer (MUX) 705. Moreover, the stereo encoder 70 comprises a stereo extension encoder 706, which is equally connected to the AMR-WB+ bitstream multiplexer 705. In addition to these components, which are also present in the stereo encoder 20 of the first embodiment, the stereo encoder 70 comprises a stereo enhancement layer encoder 707, which is connected to the AMR-WB+ mono encoder component 704, to the stereo extension encoder 706 and to the AMR-WB+ bitstream multiplexer 705.

The stereo decoder 71 comprises an AMR-WB+ bitstream demultiplexer (DEMUX) 715, which is connected on the one hand to an AMR-WB+ mono decoder component 714 and on the other hand to a stereo extension decoder 716. The AMR-WB+ mono decoder component 714 is further connected to the stereo extension decoder 716. In addition to these components, which are also present in the stereo encoder 21 of the first embodiment, the stereo encoder 71 comprises a stereo enhancement layer decoder 717, which is connected to the AMR-WB+ bitstream demultiplexer 715, to the AMR-WB+ mono decoder component 714 and to the stereo extension decoder 716.

When a stereo audio signal is to be transmitted, the left channel signal L and the right channel signal R of the stereo audio signal are provided to the stereo encoder 70. The left channel signal L and the right channel signal R are assumed to be arranged in frames.

In the stereo encoder 70, first a mono audio signal M=(L+R)/2 is generated by means of the summing point 702 and the scaling unit 703 based on the left L and right R channel signals, encoded by the AMR-WB+ mono encoder component 704 and provided to the AMR-WB+ bitstream multiplexer 705, exactly as in the first presented embodiment. Moreover, side information for a stereo extension is generated in the stereo extension encoder 706 based on the left L and right R channel signals and provided to the AMR-WB+ bitstream multiplexer 705 exactly as in the first, presented embodiment.

In the second presented embodiment, however, the original left channel signal L, the original right channel signal R, the coded mono audio signal $\tilde{M}$ and the generated side information are passed on in addition to the stereo enhancement layer encoder 707. The stereo enhancement layer encoder processes the received signals in order to obtain additional enhancement information, which ensures that, compared to the first embodiment, an improved stereo image can be achieved at the decoder side. Also this enhancement information is provided as bitstream to the AMR-WB+ bitstream multiplexer 705.

Finally, the bitstreams provided by the AMR-WB+ mono encoder component 704, the stereo extension encoder 706 and the stereo enhancement layer encoder 707 are multiplexed by the AMR-WB+ bitstream multiplexer 705 for transmission.

The transmitted multiplexed bitstream is received by the stereo decoder 71 and demultiplexed by the AMR-WB+ bitstream demultiplexer 715 into a mono signal bitstream, a side information bitstream and an enhancement information bitstream. The mono signal bitstream and the side information bitstream are processed by the AMR-WB+ mono decoder component 714 and the stereo extension decoder 716 exactly as in the first embodiment by the corresponding components, except that the stereo extension decoder 716 does not necessarily perform any IMDCT. In order to indicate this slight difference, the stereo extension decoder 716 is indicated in FIG. 7 as stereo extension decoder'. The spectral left $\tilde{L}_f$ and right $\tilde{R}_f$ channel signals obtained in the stereo extension decoder 716 are provided to the stereo enhancement layer decoder 717, which outputs new reconstructed left and right channel signals $\tilde{L}_{new}$, $\tilde{R}_{new}$ with an improved stereo image. It is to be noted that for the second embodiment, a different notation is employed for the spectral left $\tilde{L}_f$ and right $\tilde{R}_f$ channel signals generated in the stereo extension decoder 716 compared to the spectral left $L_{MDCT}$ and right $R_{MDCT}$ channel signals generated in the stereo extension decoder 29 of the first embodiment. This is due to the fact that in the first embodiment, the difference between the spectral left $L_{MDCT}$ and right $R_{MDCT}$ channel signals generated in the stereo extension encoder 26 and the stereo extension decoder 29 were neglected.

Structure and operation of the stereo enhancement layer encoder 707 and the stereo enhancement layer decoder 717 will be explained in the following.

Figure 8:
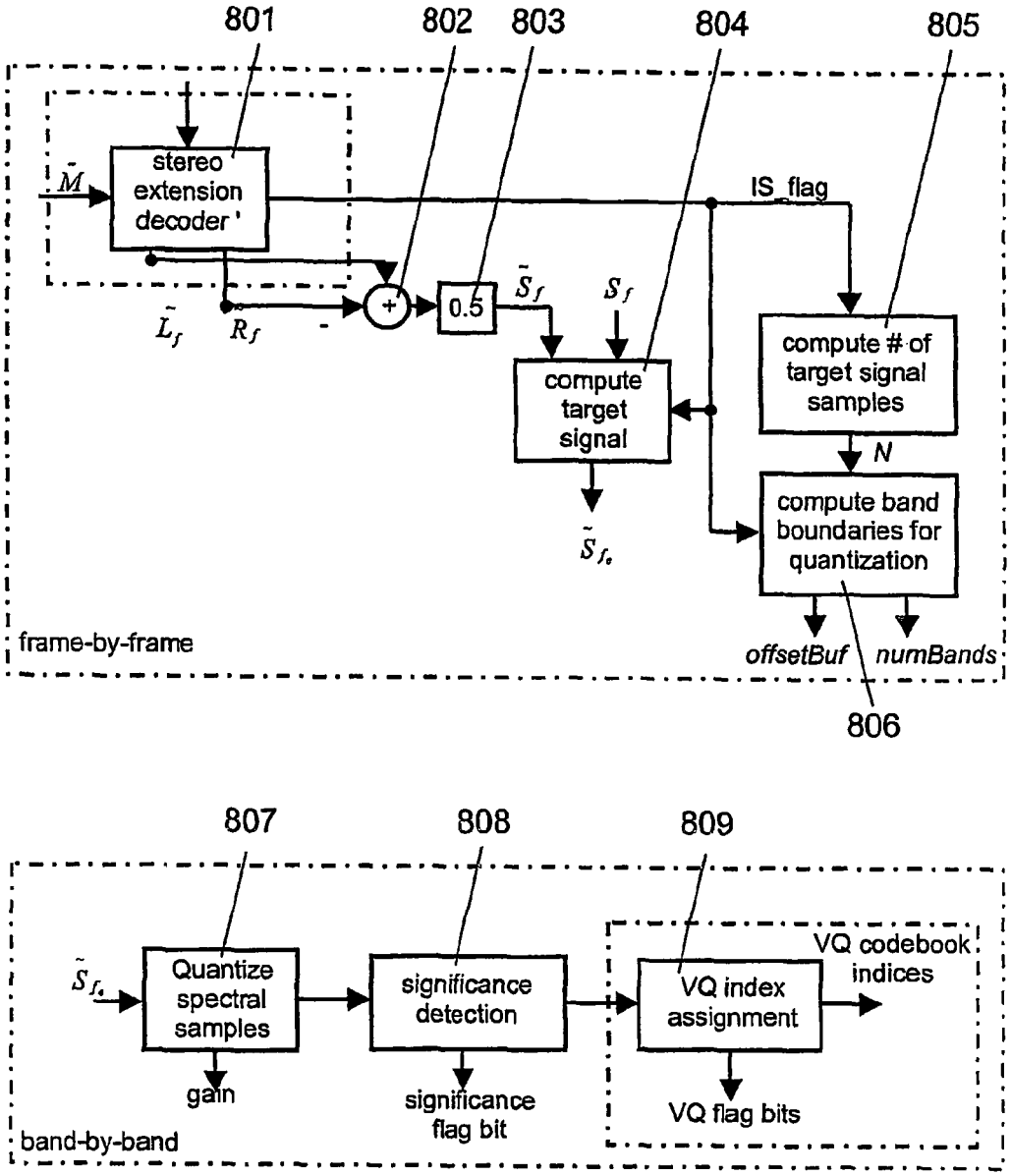
FIG. 8 illustrates the processing on a transmitting side of the stereo audio coding system of FIG. 7 in the second embodiment of the invention.

The processing in the stereo enhancement layer encoder 707 is illustrated in more detail in FIG. 8. FIG. 8 is a schematic block diagram of the stereo enhancement layer encoder 707. In the upper part of FIG. 8, components are depicted which are employed in a frame-by-frame processing in the stereo enhancement layer encoder 707, while in the lower part of FIG. 8, components are depicted which are employed in a processing on a frequency band basis in the stereo enhancement layer encoder 707. It is to be noted that for reasons of clarity, not all connections between the different components are depicted.

The components of the stereo enhancement layer encoder 707 depicted in the upper part of FIG. 8 comprises a stereo extension decoder 801, which corresponds to the stereo extension decoder 716. Two outputs of the stereo extension decoder 801 are connected via a summing point 802 and a scaling unit 803 to a first processing portion 804. A third output of the stereo extension decoder 801 is connected equally to the first processing portion 804 and in addition to a second processing portion 805 and a third processing portion 806. The output of the second processing portion 805 is equally connected to the third processing portion 806.

The components of stereo enhancement layer encoder 707 depicted in the lower part of FIG. 8 comprise a quantizing portion 807, a significance detection portion 808 and a codebook index assignment portion 809.

Based on a coded mono audio signal $\tilde{M}$ received from the AMR-WB+ mono encoder component 704 and on side information received from the stereo extension encoder 706, first an exact replica of the stereo extended signal, which will be generated at the receiving side by the stereo extension decoder 716, is generated by the stereo extension decoder 801. The processing in the stereo extension decoder 801 can thus be exactly the same as the processing performed by the stereo extension encoder 29 of FIG. 2, except that the resulting spectral left $\tilde{L}_f$ and right $\tilde{R}_f$ channel signals in the frequency domain are not transformed into the time domain, since the stereo enhancement layer encoder 707 operates as well in the frequency domain. The spectral left $\tilde{L}_f$ and right $\tilde{R}_f$ channel signals provided by the stereo extension decoder 801 thus correspond to signals $L_{MDCT}$, $R_{MDCT}$ mentioned above with reference to FIG. 4. In addition, the stereo extension decoder 801 forwards the state flags IS_flag comprised in the received side information.

It is to be noted that in a practical implementation, the internal decoding will not be performed starting from the bitstream level. Typically, an internal decoding is embedded into the encoding routines such that each encoding routine will also return the synthesized decoded output signal after processing the received input signal. The separate internal stereo extension decoder 801 is only shown for illustration purposes.

Next, a difference signal $\tilde{S}_f$ is determined from the reconstructed spectral left $\tilde{L}_f$ and right $\tilde{R}_f$ channel signals as $\tilde{S}_f=(\tilde{L}_f-\tilde{R}_f)/2$ and provided to the first processing portion 804. In addition, the original spectral left and right channel signals are used for calculating a corresponding original difference signal $S_f$, which is equally provided to the first processing portion 804. The original spectral left and right channel signals correspond to the to signals $L_{MDCT}$ and $R_{MDCT}$ mentioned above with reference to FIG. 3. The generation of the original difference signal $S_f$ is not shown in FIG. 8.

The first processing portion 804 determines a target signal $\tilde{S}_{fe}$ out of the received difference signal $\tilde{S}_f$ and the received original difference signal $S_f$ according to the following equations:

$$\tilde{S}_{fe} = s_{(j)},\ 0 \le j < numTotalBands \tag{18}$$

$$s_{(k)} = \begin{cases} E_{f(k)}, & \text{if IS_flag}(k) \text{ != CENTER} \\ & \text{skipped otherwise} \end{cases}$$

$$E_{f(k)} = S_f(offset+n) - \tilde{S}_f(offset+n),\ 0 \le n < \text{IS_WidthLenBuf}[k]$$

The parameter offset indicates the offset in samples to the start of spectral samples in frequency band k.

Target signal $\tilde{S}_{fe}$ thus indicates in the frequency domain to which extend the signals reconstructed by the stereo extension decoder 716 will differ from the original stereo channel signals. After a quantization, this signal constitutes the enhancement information that is to be transmitted in addition by the stereo audio encoder 70.

Equation (18) takes into account only those spectral samples from the difference signals that belong to a frequency band which has been determined to be relevant by the stereo extension encoder 706 from the stereo image point of view. This relevance information is forwarded to the first processing portion 804 in form of the state flags IS_flag by the stereo extension decoder 801. It is quite safe to assume that those frequency bands to which the CENTER state has been assigned are more or less irrelevant from a spatial perspective. Also the second embodiment is not aiming at reconstructing the exact replica of the stereo image but a close approximation at relatively low bitrates.

The target signal $\tilde{S}_{fe}$ will be quantized by the quantizing component 807 on a frequency band basis, and to this end, the number of frequency bands considered to be relevant and the frequency band boundaries have to be known.

In order to be able to determine the number of frequency bands and the frequency band boundaries, first the number of spectral samples present in signal $\tilde{S}_{fe}$ have to be known. This number of spectral samples is thus determined in the second processing portion 805 based on the received state flags IS_flag according to the following equation:

$$N = \sum_{i=0}^{numTotalBands-1} \begin{cases} \text{IS_WidthLenBuf}[i], & \text{if IS_flag}(i) \\ 0, & \text{otherwise} \end{cases} \tag{19}$$

$$\text{!= CENTER}$$

The number of relevant frequency bands numBands and the frequency band boundaries offsetBuf[n] are then calculated by the third processing portion 806, for example as described in the following, first pseudo C-code:

```
numBands = 0;
offsetBuf[0] = 0;
If (N)
{
    int16 loopLimit;
    If (N <= 50)
        loopLimit = 2;
    else if (N <= 85)
        loopLimit = 3;
    else if (N <= 120)
        loopLimit = 4;
    else if (N <= 180)
        loopLimit = 5;
    else if (N <= frameLen)
        loopLimit = 6;
    for(i = 1; i < (loopLimit + 1); i++)
    {
        numBufs++;
        bandLen = Minimum(qBandLen[i-1], N / 2);
        if(offset < qBandLen[i-1])
            bandLen = N;
        offsetBuf[i] = offsetBuf[i - 1] + bandLen;
        N -= bandLen;
        if (N <= 0) break;
    }
}
```

where qBandLen describes the maximum length of each frequency band. In the current embodiment, the maximum lengths of the frequency bands is given by qBandLen={22, 25, 32, 38, 44, 49}. The width of each frequency band bandLen is also determined by the above procedure.

Figure 9:
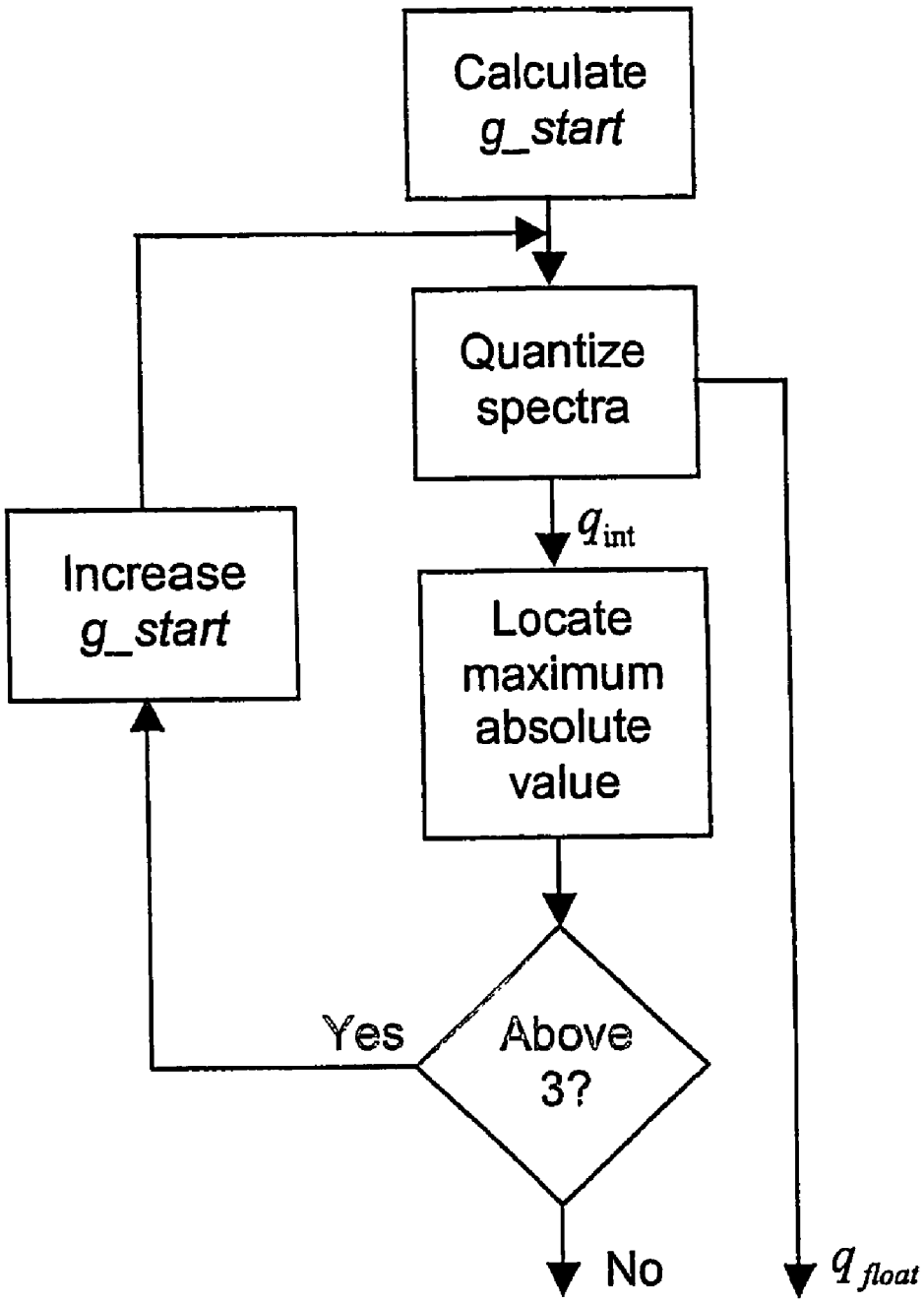
FIG. 9 is a flow chart illustrating a quantization loop used in the processing of FIG. 8.

The quantization portion 807 now quantizes the target signal $\tilde{S}_{fe}$ on a frequency band basis in a respective quantization loop, which is shown in FIG. 9. The spectral samples for each frequency band are to be quantized more specifically to range [−a, a]. In the present embodiment, the range is currently set to [−3, 3].

The respectively selected quantizing range is observed by adjusting the quantization gain value.

To this end, first a starting value for the quantization gain is determined based on the following equation:

$$g_{start}(n) = 5.3 \cdot \log_2\left(\frac{\text{Maximum}\left(\tilde{S}_{fo}(i)\right)^{0.75}}{256}\right), \quad offsetBuf[n] \le i < offsetBuf[n+1] \tag{20}$$

A separate starting value $g_{start}(n)$ is determined for each relevant frequency band, i.e. for 0≦n<numBands.

Then, the quantization is performed on a sample-by-sample basis according to the following set of equations:

$$\begin{aligned} q(i) &= \left(\left|\tilde{S}_{fo}(i)\right| \cdot 2^{-0.25 \cdot g_{start}(n)}\right)^{0.75}, \quad offsetBuf[n] \le i < offsetBuf[n+1] \\ q_{int}(i) &= \left\lfloor (q(i) + 0.4554) \cdot \text{sign}\left(\tilde{S}_{fo}(i)\right) \right\rfloor \\ q_{float}(i) &= q(i) \cdot \text{sign}\left(\tilde{S}_{fo}(i)\right) \\ \text{sign}(x) &= \begin{cases} -1, & \text{if } x \le 0 \\ 1, & \text{otherwise} \end{cases} \end{aligned} \tag{21}$$

Also these calculations are performed separately for each relevant frequency band, i.e. for 0≦n<numBands.

For each frequency band, then the maximum absolute value of $q_{int}(i)$ is determined. In case this maximum absolute value is larger than 3, the starting gain $g_{start}$ is increased and the quantization according to equations (21) is repeated for the respective frequency band, until the maximum absolute value of $q_{int}(i)$ is not larger than 3 anymore. The values $q_{float}(i)$ corresponding to the final values $q_{int}(i)$ constitute quantized enhancement samples for the respective frequency band.

The quantizing portion 807 provides on the one hand the final gain value for each relevant frequency band for transmission. On the other hand, the quantizing portion 807 forwards the final gain value, the quantized enhancement samples $q_{float}(i)$ and the additional values $q_{int}(i)$ for each relevant frequency band to the significance detection portion 808.

In the significance detection portion 808, a first significance detection measure of the quantized spectra is calculated, before passing the quantized enhancement samples to a vector quantization (VQ) index assignment routine. The significance detection measure indicates whether the quantized enhancement samples of a respective frequency band have to be transmitted or not. In the presented embodiment, gain values below 10 and the presence of exclusively zero-valued additional values $q_{int}$ trigger the significance detection measure to indicate that the corresponding quantized enhancement samples $q_{float}$ of a specific frequency band are irrelevant and need not to be transmitted. In another embodiment, also calculations between frequency bands might be included, in order to locate perceptually important stereo spectral bands for transmission.

The significance detection portion 808 provides for each frequency band a corresponding significance flag bit for transmission, more specifically a significance flag bit having a value of '0', if the spectral quantized enhancement samples of a frequency band are considered to be irrelevant, and a significance flag bit having a value of '1' otherwise. The significance detection portion 808 moreover forwards the quantized enhancement samples $q_{float}(i)$ and the additional values $q_{int}(i)$ of those frequency bands, of which the quantized enhancement samples were considered to be significant, to the codebook index assignment portion 809.

The codebook index assignment portion 809 applies VQ index assignment calculations on the received quantized enhancement samples.

The VQ index assignment routine applied by the codebook index assignment portion 809 processes the received quantized values in groups of m successive quantized spectral enhancement samples. Since m may not be divisible with the width of each frequency band bandLen, the boundaries of each frequency band offsetBuf[n] are modified before the actual quantization starts, for example as described in the following second pseudo C-code:

```
for (i = 0; i< numBands; i++)
{
    int16 bandLen, offset;
    offset = offsetBuf[i];
    bandLen = offsetBuf[i + 1] − offsetBuf[i];
    if(bandLen % m)
    {
```

-continued

```
            bandLen -= bandLen % m;
            offsetBuf[i + 1] = offset + bandLen;
        }
    }
```

Figure 10:
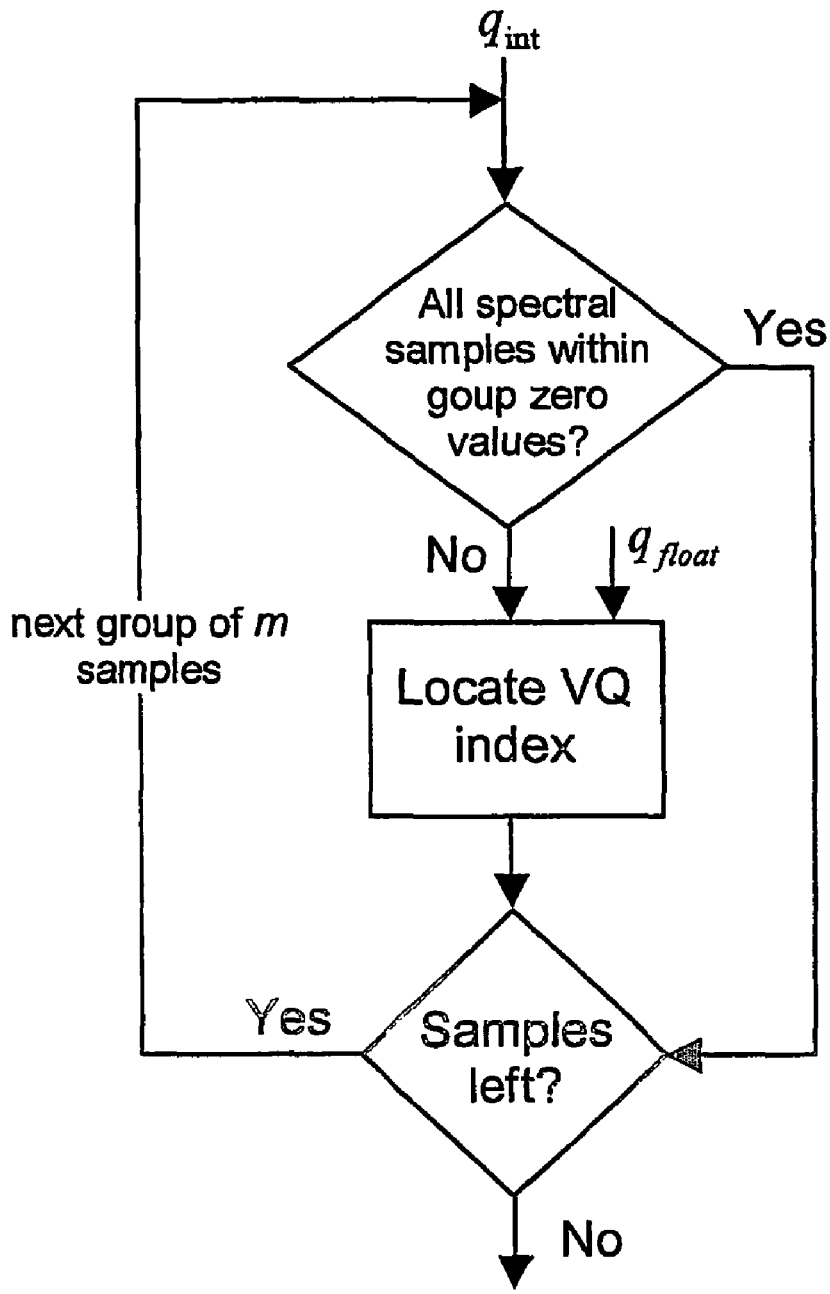
FIG. 10 is a flow chart illustrating a codebook index assignment loop used in the processing of FIG. 8.

The VQ index assignment routine, which is illustrated in FIG. 10, first determines in a second significance detection measure for a respective group of m quantized enhancement samples, whether the group is to be considered to be significant.

A group is considered to be insignificant if all additional values $q_{int}$ corresponding to the quantized enhancement samples $q_{float}$ within the group have a value of zero. In this case, the routine only provides a VQ flag bit having a value of '0' and then passes immediately on to the next group of m samples, as long as any samples are left. Otherwise, the VQ index assignment routine provides a VQ flag bit having a value of '1' and assigns a codebook index to the respective group. The VQ search for assigning codebook indices is based on the quantized enhancement samples $q_{float}$, not the additional values $q_{int}$. The reason is that the $q_{float}$ values are better suited for the VQ index search, since the $q_{int}$ values are rounded to the nearest integer and a vector quantization does not operate optimally in the integer domain. In the present embodiment, the value m is set to 3 and each group of m successive samples are coded in the vector quantization with three bits. Only then, the routine passes to the next group of m samples, in case any samples are left.

Typically, for most of the frames, the VQ flag bit would be set to '1'. In this case, it would not be efficient to transmit this VQ flag bit for each spectral group within the frequency band. But occasionally, there may be frames for which the encoder would need the VQ flag bits for each spectral group. For this reason, the VQ index assignment routine is organized such that before the actual search of the best VQ indices starts, the number of groups having also relevant quantized enhancement samples is counted. The groups having also relevant quantized enhancement samples will also be referred to as significant groups. If the number of significant groups is the same as the number of groups within the current frequency band, a single bit having a value of '1' is provided for transmission, which indicates that all groups are significant and that therefore, the VQ flag bit is not needed. In case the number of significant groups is not the same as the number of groups within the current frequency band, a single bit having a value of '0' is provided for transmission, which indicates that to each group of m quantized spectral enhancement samples a VQ flag bit is associated that indicates whether a VQ codebook index is present for the respective group or not.

The codebook index assignment portion 809 provides for each frequency band the single bit, assigned VQ codebook indices for all significant groups and, possibly, in addition VQ flag bits indicating which of the groups are significant.

In order to enable an efficient operation of the quantization, in addition the available bitrate may be taken into account. Depending on the available bitrate, the encoder can transmit either more or less quantized spectral enhancement samples $q_{float}$ in groups of m. If the available bitrate is low, then the encoder may send for example only the quantized spectral enhancement samples $q_{float}$ in groups of m for the first two frequency bands, whereas if the available bitrate is high, the encoder may send for example the quantized spectral enhancement samples $q_{float}$ in groups of m for the first three frequency bands. Also depending on the available bitrate, the encoder may stop transmitting the spectral groups at some location within the current frequency band if the number of used bits is exceeding the number of available bits. The bitrate of the whole stereo extension, including both, the stereo extension encoding and the stereo enhancement layer encoding, is then signaled in a stereo enhancement layer bitstream comprising the enhancement information.

In the presented embodiment, bitrates of 6.7, 8, 9.6, and 12 kbps are defined, and 2 bits are reserved for signaling the respectively employed bitrate brMode. Typically, the average bitrate of the first presented embodiment will be smaller than the maximum allowed bitrate, and the remaining bits can be allocated to the enhancement layer of the presented second embodiment. This is also one of the advantages of the in-band signaling, since basically the stereo enhancement layer encoder 707 is able to use all the bits available. When using in-band signaling, the decoder is then able to detect when to stop decoding simply by accumulating the number of decoded bits and comparing that value to the maximum allowed number of bits. If the decoder monitors the bit consumption in the same manner as the encoder, the decoding stops exactly in the same location where the encoder stopped transmitting.

The bitrate indication, the quantization gain values, the significance flag bits, the VQ codebook indices and the VQ flag bits are provided by the stereo enhancement layer encoder 707 as enhancement information bitstream to the AMR-WB+ bitstream multiplexer 705 of the stereo encoder 70 of FIG. 7.

The bitstream elements of the enhancement information bitstream can be organized for transmission for example as shown in the following third pseudo C-code:

```
Enhancement_StereoData(numBands)
{
    brMode = BsGetBits(2);
    for(i=0; i < numBands; i++)
    {
        int16 bandLen, offset;
        offset = offsetBuf[i];
        bandLen = offsetBuf[i + 1] - offsetBuf[i];
        if(bandLen % m)
        {
            bandLen -= bandLen % m;
            offsetBuf[i + 1] = offset + bandLen;
        }
        bandPresent= BsGetBits(1);
        if(bandPresent == 1)
        {
            int16 vqFlagPresent;
            gain[i]= BsGetBits(6) + 10;
            vqFlagPresent= BsGetBits(1);
            for(j = 0; j < bandLen; j++)
        {
                int16 vqFlagGroup = TRUE;
                if(vqFlagPresent == FALSE)
                vqFlagGroup= BsGetBits(1);
                if(vqFlagGroup)
                codebookIdx[i][j] = BsGetBits(3);
        }
    }
}
```

Here, brMode indicates the employed bitrate, bandPresent constitutes the significance flag bit for a respective frequency band, gain[i] indicates the quantization gain employed for a respective frequency band, vqFlagPresent indicates whether a VQ flag bits is associated to the spectral groups of a specific frequency band, vqFlagGroup constitutes the actual VQ flag bit indicating whether a respective group of m samples is significant, and codebookIdx [i] [j] represents the codebook index for a respective significant group.

The AMR-WB+ bitstream multiplexer 705 multiplexes the received enhancement information bitstream with the received side information bitstream and the received mono signal bitstream for transmission, as described above with reference to FIG. 7.

The transmitted signal is received by the stereo decoder 71 of FIG. 7 and processed by the AMR-WB+ bitstream demultiplexer 715, the AMR-WB+ mono decoder component 714 and the stereo extension decoder 716 as described above.

Figure 11:
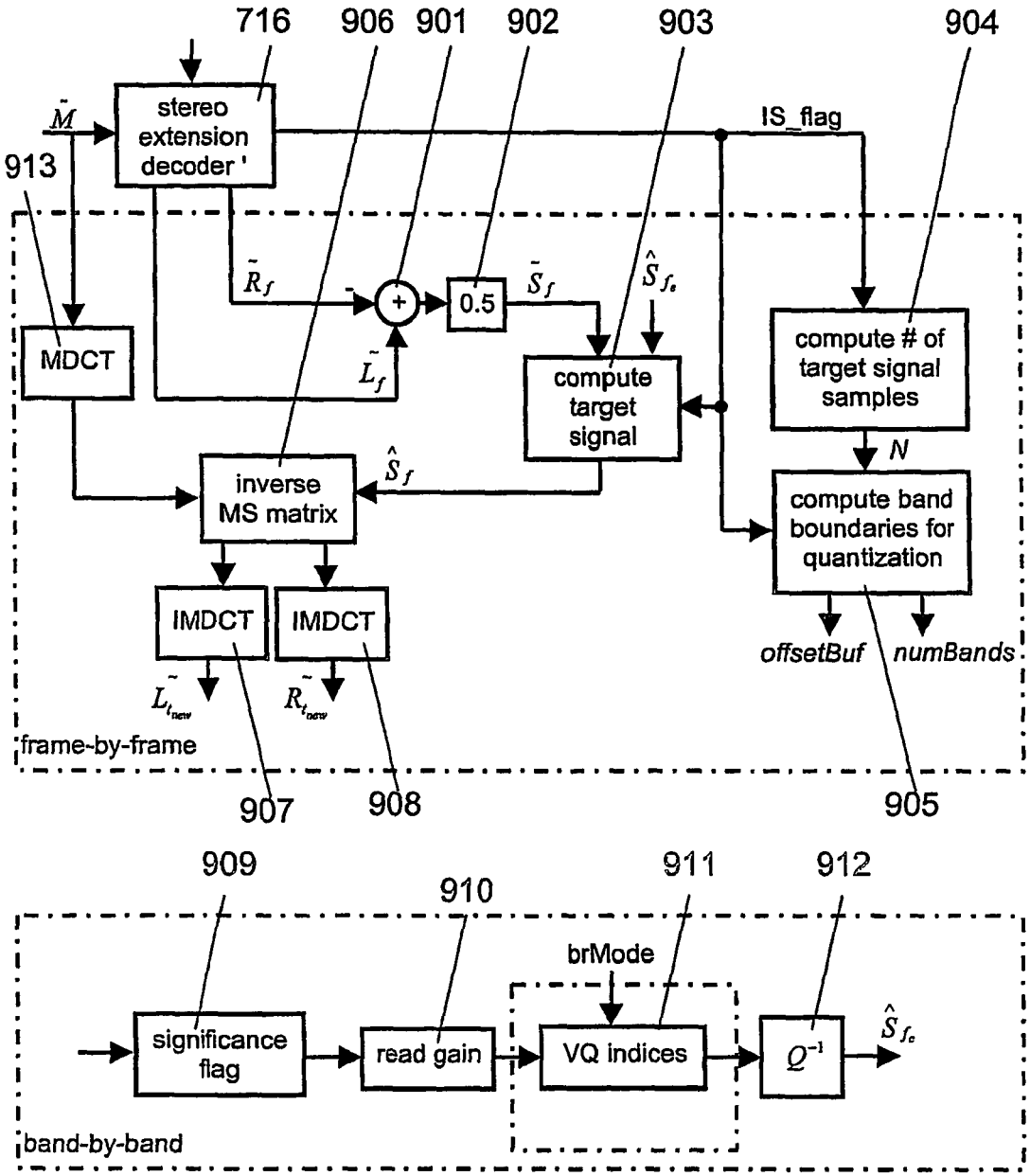
FIG. 11 illustrates the processing on a receiving side of the stereo audio coding system of FIG. 7 in the second embodiment of the invention.

The processing in the stereo enhancement layer decoder 717 of the stereo decoder 71 of FIG. 7 is illustrated in more detail in FIG. 11. FIG. 11 is a schematic block diagram of the stereo enhancement layer decoder 717. In the upper part of FIG. 11, components are depicted which are employed in a frame-by-frame processing in the stereo enhancement layer decoder 717, while in the lower part of FIG. 11, components are depicted which are employed in a processing on a frequency band basis in the stereo enhancement layer decoder 717. Still above the upper part of FIG. 11, further the stereo extension decoder 716 of FIG. 7 is depicted again. It is to be noted that for reasons of clarity, again not all connections between the different components are depicted.

The components of the stereo enhancement layer decoder 717 depicted in the upper part of FIG. 11 comprise a summing point 901, which is connected to two outputs of the stereo extension decoder 716 providing the reconstructed spectral left $\tilde{L}_f$ and right $\tilde{R}_f$ channel signal. The summing point 901 is connected via a scaling unit 902 to a first processing portion 903. A further output of the stereo extension decoder 716 forwarding the received state flags IS_flag is connected directly to the first processing portion 903, to a second processing portion 904 and to a third processing portion 905 of the stereo enhancement layer decoder 717. The first processing portion 903 is moreover connected to an inverse MS matrix component 906. The output of the AMR-WB+ mono decoder component 714 providing the mono audio signal $\tilde{M}$ is equally connected via an MDCT portion 913 to this inverse MS matrix component 906. The inverse MS matrix component 906 is connected in addition to a first IMDCT portion 907 and a second IMDCT portion 908.

The components of the stereo enhancement layer decoder 717 depicted in the lower part of FIG. 11 comprise a significance flag reading portion 909, which is connected via a gain reading portion 910 and a VQ lookup portion 911 to a dequantization portion 912.

An enhancement information bitstream provided by the AMR-WB+ bitstream demultiplexer 715 is parsed according to the bitstream syntax presented above in the third pseudo C-code.

Further, the second processing portion 904 determines based on state flags IS_flag received from the stereo extension decoder 716 the number of target signal samples in the enhancement bitstream according to above equation (18). This sample number is then used by the third processing portion 905 for calculating the number of relevant frequency bands numBands and the frequency band boundaries offsetBuf, e.g. according to the above presented first pseudo C-code.

The significance flag reading portion 909 reads the significance flag bandPresent for each frequency band and forwards the significance flags to the gain reading portion 910. The gain reading portion 910 reads the quantization gain gain[i] for a respective frequency band and provides the quantization gain for each significant frequency band to the VQ lookup portion 911.

The VQ lookup portion 911 further reads the single bit vqFlagPresent which indicates whether VQ flag bits are associated to the spectral groups, the actual VQ flag bit vqFlagGroup for each spectral group, if the value of the single bit is '0', and the received codebook indices codebookIdx[i] [j] for each spectral group, if the single bit has a value of '1', or otherwise for each spectral group for which the VQ flag bit is equal to '1'.

The VQ lookup portion 911 receives in addition the indication of the employed bitrate brMode, and performs in accordance with the above presented second pseudo C-code modifications to the band boundaries offsetBuf determined by the third processing portion 5.

The VQ lookup portion 911 then locates quantized enhancement samples $g_{float}$ corresponding to the original quantized enhancement samples $g_{float}$ in groups of m samples based on the decoded codebook indices.

The quantized enhancement samples $g_{float}$ are then provided to the dequantization portion 912, which performs a dequantization according to the following equations:

$$\hat{S}_{fe}(i) = \mathrm{sign}(g_{float}(i)) \cdot g_{float}(i)^{133} \cdot 2^{-0.25 \cdot gain(n)}, \quad offsetBuf[n] \le i < offsetBuf[n+1] \tag{22}$$

$$\mathrm{sign}(x) = \begin{cases} -1, & \text{if } x \le 0 \\ 1, & \text{otherwise} \end{cases}$$

The above equations are applied for each relevant frequency band, i.e. for $0 \leqq n < \text{numBands}$, the values of offsetBuf and numBands being provided by the third processing portion 905.

Next, the dequantized samples $\hat{S}_{fe}$ are provided to the first processing portion 903.

The first processing portion 903 receives in addition a side signal $\tilde{S}_f$, which is calculated by the summing point 901 and the scaling unit 902 from the spectral left $\tilde{L}_f$ and right $\tilde{R}_f$ channel signal received from the stereo extension decoder 716 as $\tilde{S}_f = (\tilde{L}_f - \tilde{R}_f)/2$.

The first processing portion 903 now adds the received dequantized samples $\hat{S}_{fe}$ to the received side signal $\tilde{S}_f$ according to the following equations:

$$\hat{S}_j = s_{(j)}, \quad 0 \le j < numTotalBands \tag{23}$$

$$s_{(k)} = \begin{cases} E_{f(k)}, & \text{if IS_flag}(k) \text{ != CENTER} \\ & \text{skipped otherwise} \end{cases}$$

$$E_{f(k)} = \tilde{S}_f(\text{offset} + n) + \hat{S}_{fo}(\text{offset} + n), \quad 0 \le n < \text{IS_WidthLenBuf}[k]$$

where the parameter offset is the offset in samples to the start of the spectral samples in the frequency band k.

The resulting samples $\hat{S}_f$ are provided to the inverse MS matrix portion 906. Moreover, the MDCT portion 913 applies an MDCT on the mono audio signal $\tilde{M}$ output by the AMR-WB+ mono decoder component 714 and provides the resulting spectral mono audio signal $\tilde{M}_f$ equally to the inverse MS matrix portion 906. The inverse MS matrix component 906 applies an inverse MS matrix to those spectral samples for which non-zero quantized enhancement samples were transmitted in the enhancement layer bitstream, that is the inverse MS matrix component 906 calculates for these spectral samples $\tilde{L}_f=\tilde{M}_f+\hat{S}_f$ and $\tilde{R}_f=\tilde{M}_f-\hat{S}_f$. The remaining samples of the spectral left $\tilde{L}_f$ and right $\tilde{R}_f$ channel signal provided by the stereo extension decoder 716 remain unchanged. All spectral left channel signals $\tilde{L}_f$ are then provided to the first IMDCT portion 907 and all spectral right $\tilde{R}_f$ channel signals are provided to the second IMDCT portion 907.

Finally, the spectral left channel signals $\tilde{L}_f$ are transformed by the IMDCT portion 907 into the time domain by means of a frame based IMDCT, in order to obtain an enhanced restored left channel signal $\tilde{L}_{new}$, which is then output by the stereo decoder 71. At the same time, the spectral right channel signals $\tilde{R}_f$ are transformed by the IMDCT portion 908 into the time domain by means of a frame based IMDCT, in order to obtain an enhanced restored right channel signal $\tilde{R}_{new}$, which is equally output by the stereo decoder 71.

It is to be noted that the described embodiment constitutes only one of a variety of possible embodiments of the invention.

What is claimed is:

1. A method for supporting a multichannel audio extension at an encoding end of a multichannel audio coding system, said method comprising:

transforming a first channel signal of a multichannel audio signal into the frequency domain, resulting in a spectral first channel signal;

transforming a second channel signal of said multichannel audio signal into the frequency domain, resulting in a spectral second channel signal; and determining for each of a plurality of adjacent frequency bands of said transformed multichannel audio signals whether said spectral first channel signal, said spectral second channel signal or none of said spectral channel signals is dominant in the respective frequency band and providing a corresponding state information for each of said adjacent frequency bands.

2. The method according to claim 1, further comprising in case it was determined that one of said spectral first channel signal and said spectral second channel signal is dominant in at least one of said frequency bands calculating providing at least one gain value representative of the degree of said dominance.

3. The method according to claim 2, wherein said at least one gain value comprises a dedicated gain value for each of said frequency bands, each dedicated gain value being representative of the degree of the determined dominance of the respective dominant one of said spectral first channel signal and said spectral second channel signal in the respective frequency band.

4. The method according to claim 2, wherein said at least one gain value comprises a common gain value representing an average degree of a dominance of said spectral first channel signal and said spectral second channel signal in all of said frequency bands.

5. The method according to claim 1, wherein said state information is coded according to one of several coding schemes, the coding scheme being selected at least partly depending on which one of said spectral first channel signal and said spectral second channel signal is more frequently dominant in all of said frequency bands.

6. The method according to claim 1, further comprising generating a reconstructed spectral first channel signal and a reconstructed spectral second channel signal based on said state information and on a mono channel version of said first channel signal and said second channel signal; and generating and providing for those frequency bands, for which said state information indicates that one of said channel signals is dominant, an enhancement information which reflects on a sample basis the difference between said reconstructed spectral first and second channel signals on the one hand and said original spectral first and second channel signals on the other hand.

7. The method according to claim 6, wherein generating said enhancement information comprises quantizing said difference on a frequency band basis sample-by-sample to a predetermined range by adjusting a quantization gain for the respective frequency band, said quantizing resulting in quantized spectral enhancement samples, wherein said quantization gain employed for a respective frequency band are provided as part of said enhancement information.

8. The method according to claim 6, further comprising providing an information on a bitrate employed for providing at least said state information and said enhancement information, said information on said bitrate being provided as part of said enhancement information.

9. A method for supporting a multichannel audio extension at a decoding end of a multichannel audio coding system, said method comprising:

transforming a received mono audio signal into the frequency domain, resulting in a spectral mono audio signal; and generating a spectral first channel signal and a spectral second channel signal out of said spectral mono audio signal by weighting said spectral mono audio signal separately in each of a plurality of adjacent frequency bands for each of said spectral first channel signal and said spectral second channel signal based on at least one gain value and in accordance with a received state information, said state information indicating for each of said adjacent frequency bands whether said spectral first channel signal, said spectral second channel signal or none of said spectral channel signals is to be dominant within the respective frequency band.

10. The method according to claim 9, comprising generating said spectral first channel signal within each of said frequency bands by multiplying one of said at least one gain values valid for a respective frequency band with samples of said spectral mono audio signal within said respective frequency band in case said state information indicates for said respective frequency band a dominance of said first channel signal, by multiplying the reciprocal value of said gain value with samples of said spectral mono audio signal within said respective frequency band in case said state information indicates for said respective frequency band a dominance of said second channel signal, and by taking over said spectral mono audio signal within said respective frequency band otherwise; and generating said spectral second channel signal within each of said frequency bands by multiplying one of said at least one gain values valid for a respective frequency band with samples of said spectral mono audio signal within said respective frequency band in case said state information indicates for said respective frequency band a dominance of said second channel signal, by multiplying the weighted or not-weighted reciprocal value of said gain value with samples of said spectral mono audio signal within said respective frequency band in case said state information indicates for said respective frequency band a dominance of said first channel signal, and by taking over said spectral mono audio signal within said respective frequency band otherwise.

11. The method according to claim 9, wherein said at least one gain value comprises a dedicated gain value for each of said plurality of frequency bands.

12. The method according to claim 11, wherein said mono audio signal is arranged in frames, wherein said gain values are smoothed at the start of each frame by averaging the gain value valid for the respective frequency band and the gain value valid for the respective next lower frequency band, and wherein said gain values are smoothed at the end of each frame by averaging the gain value valid for the respective frequency band and the gain value valid for the respective next higher frequency band.

13. The method according to claim 9, wherein for obtaining said state information, a received state information bitstream is decoded, which state information bitstream comprises at least partly in addition to said state information a coding scheme information, said coding scheme information indicating a coding scheme which has been employed for encoding said state information, said state information being decoded based on said coding scheme information.

14. The method according to claim 9, further comprising receiving enhancement information which reflects at least for some spectral sample of those frequency bands, for which said state information indicates that one of said channel signals is dominant, on a sample basis the difference between said generated spectral first and second channel signals on the one hand and original spectral first and second channel signals on the other hand;

generating enhanced spectral first and second channel signals by taking into account on a sample-by-sample basis said difference reflected by said enhancement information; and transforming said enhanced spectral first and second channel signals into the time domain, resulting in a first channel signal and a second channel signal of a reconstructed multichannel audio signal.

15. An apparatus comprising a stereo extension encoder implemented at least partly in hardware, said stereo extension encoder configured to transform a first channel signal of a multichannel audio signal into the frequency domain, resulting in a spectral first channel signal;

said stereo extension encoder configured to transform a second channel signal of said multichannel audio signal into the frequency domain, resulting in a spectral second channel signal;

said stereo extension encoder configured to determine for each of a plurality of adjacent frequency bands of said transformed multichannel audio signals whether said spectral first channel signal, said spectral second channel signal or none of said spectral channel signals is dominant in the respective frequency band; and said stereo extension encoder configured to provide a corresponding state information for each of said adjacent frequency bands.

16. The apparatus according to claim 15, wherein said stereo extension encoder is further configured to calculate and provide at least one gain value representative of the degree of said dominance, in case it was determined that one of said spectral first channel signal and said spectral second channel signal is dominant in at least one of said frequency bands.

17. The apparatus according to claim 16, wherein said at least one gain value comprises a dedicated gain value for each of said frequency bands, each dedicated gain value being representative of the degree of the determined dominance of the respective dominant one of said spectral first channel signal and said spectral second channel signal in the respective frequency band.

18. The apparatus according to claim 17, wherein said stereo extension encoder is configured to calculate channel weights for said spectral first channel signal and for said spectral second channel signal separately for each of said frequency bands based on the levels of spectral samples in said spectral channel signals, and wherein said stereo extension encoder is configured to determine said dedicated gain value for a particular frequency band to correspond to the ratio between the higher weight calculated for one of said spectral channel signals for said particular frequency band and the lower weight calculated for the respective other one of said spectral channel signals for said particular frequency band.

19. The apparatus according to claim 16, wherein said at least one gain value comprises a common gain value representing an average degree of a dominance of said spectral first channel signal and said spectral second channel signal in all of said frequency bands.

20. The apparatus according to claim 19, wherein said stereo extension encoder is configured to calculate channel weights for said spectral first channel signal and for said spectral second channel signal separately for each of said frequency bands based on the levels of spectral samples in said spectral channel signals, and wherein said stereo extension encoder is configured to determine a preliminary dedicated gain value for each frequency band to correspond to the ratio between the higher weight calculated for one of said spectral channel signals for a respective frequency band and the lower weight calculated for the respective other one of said spectral channel signals for said respective frequency band, and to determine said common gain value to be the average of said preliminary dedicated gain values.

21. The apparatus according to claim 15, wherein the stereo extension encoder is further configured to code said state information according to one of several coding schemes, the coding scheme being selected at least partly depending on which one of said spectral first channel signal and said spectral second channel signal is more frequently dominant in all of said frequency bands.

22. The apparatus according to claim 15, wherein said stereo extension encoder is configured to calculate channel weights for said spectral first channel signal and for said spectral second channel signal separately for each of said frequency bands based on the levels of spectral samples in said spectral channel signals, and to assume the presence of a dominance in a particular one of said frequency bands in case the ratio between the higher channel weight resulting for said frequency band and the lower channel weight resulting for said frequency band reaches or exceeds a predetermined threshold value.

23. The apparatus according to claim 15, further comprising an enhancement layer encoder implemented at least partly in hardware, said enhancement layer encoder configured to generate a reconstructed spectral first channel signal and a reconstructed spectral second channel signal based on said state information and on a mono channel version of said first channel signal and said second channel signal; and said enhancement layer encoder configured to generate and provide for those frequency bands, for which said state information indicates that one of said channel signals is dominant, an enhancement information which reflects on a sample basis the difference between said reconstructed spectral first and second channel signals on the one hand and said original spectral first and second channel signals on the other hand.

24. The apparatus according to claim 23, wherein for generating and providing said enhancement information said enhancement layer encoder is configured to quantize said difference on a frequency band basis sample-by-sample to a predetermined range by adjusting a quantization gain for the respective frequency band, said quantizing resulting in quantized spectral enhancement samples, and to provide said quantization gain employed for a respective frequency band as part of said enhancement information.

25. The apparatus according to claim 24, wherein said enhancement layer encoder is configured to provide said quantized spectral enhancement samples for said enhancement information only for those frequency bands for which quantized spectral enhancement samples having non-zero values are available and which frequency bands require a quantization gain exceeding a specific threshold, and to provide an identification of those frequency bands for which said quantized spectral enhancement samples are provided for said enhancement information as part of said enhancement information.

26. The apparatus according to claim 24, wherein for generating and providing said enhancement information said enhancement layer encoder is further configured to assign said quantized spectral enhancement samples in groups of a predetermined number of samples to a respective codebook index, and to provide said codebook indices as part of said enhancement information.

27. The apparatus according to claim 23, wherein said enhancement layer encoder is further configured to provide an information on a bitrate employed for providing at least said state information and said enhancement information, said information on said bitrate being provided as part of said enhancement information.

28. The apparatus according to claim 15, wherein said apparatus is one of: a multichannel audio encoder, a multichannel extension encoder for a multichannel audio encoder and a mobile terminal.

29. An apparatus comprising a stereo extension decoder implemented at least partly in hardware, said stereo extension decoder configured to transform a received mono audio signal into the frequency domain, resulting in a spectral mono audio signal; and said stereo extension decoder configured to generate a spectral first channel signal and a spectral second channel signal out of said spectral mono audio signal by weighting said spectral mono audio signal separately in each of a plurality of adjacent frequency bands for each of said spectral first channel signal and said spectral second channel signal based on at least one gain value and in accordance with a received state information, said state information indicating for each of said adjacent frequency bands whether said spectral first channel signal, said spectral second channel signal or none of said spectral channel signals is to be dominant within the respective frequency band.

30. The apparatus according to claim 29, wherein said stereo extension decoder is configured to delay said mono audio signal before being transformed into the time domain, in case said mono audio signal is not time-aligned with an original multichannel audio signal which is to be reconstructed.

31. The apparatus according to claim 29, wherein said at least one gain value comprises a dedicated gain value for each of said plurality of frequency bands.

32. The apparatus according to claim 31, wherein said mono audio signal is arranged in frames, and wherein said stereo extension decoder is configured to smooth said gain values at the start of each frame by averaging the gain value valid for the respective frequency band and the gain value valid for the respective next lower frequency band, and to smooth said gain values at the end of each frame by averaging the gain value valid for the respective frequency band and the gain value valid for the respective next higher frequency band.

33. The apparatus according to claim 29, wherein said stereo extension decoder is configured to decode a received state information bitstream for obtaining said state information, which state information bitstream comprises at least partly in addition to said state information a coding scheme information, said coding scheme information indicating a coding scheme which has been employed for encoding said state information, and wherein said stereo extension decoder configured to decode said state information based on said coding scheme information.

34. The apparatus according to claim 29, further comprising an enhancement layer decoder implemented at least partly in hardware, said enhancement layer decoder being configured to receive enhancement information which reflects at least for some spectral sample of those frequency bands, for which said state information indicates that one of said channel signals is dominant, on a sample basis the difference between said generated spectral first and second channel signals on the one hand and original spectral first and second channel signals on the other hand;

said enhancement layer decoder being configured to generate enhanced spectral first and second channel signals by taking into account on a sample-by-sample basis said difference reflected by said enhancement information; and said enhancement layer decoder being configured to transform said enhanced spectral first and second channel signals into the time domain, resulting in a first channel signal and a second channel signal of a reconstructed multichannel audio signal.

35. The apparatus according to claim 34, wherein said enhancement layer decoder is configured to obtain said difference by dequantizing quantized spectral enhancement samples obtained from said received enhancement information, said dequantizing employing a dedicated quantization gain for each frequency band for which quantized spectral enhancement samples are available, wherein said quantization gains are indicated in said enhancement information.

36. The apparatus according to claim 35, wherein said received enhancement information identifies in addition those frequency bands among all frequency bands for which said state information indicates that one of said channel signals is dominant, for which frequency bands quantized spectral enhancement samples are available, and wherein said enhancement layer decoder is configured to take said identification of frequency bands into account in generating said enhanced spectral first and second channel signals.

37. The apparatus according to claim 35, wherein said enhancement layer decoder is configured to obtain said quantized spectral enhancement samples from said received enhancement information by an inverse codebook mapping of codebook indices comprised in said received enhancement information to values of a respective group of a predetermined number of quantized spectral enhancement samples.

38. The apparatus according to claim 37, wherein said received enhancement information comprises only codebook indices for selected groups of samples, wherein said enhancement information further comprises an identification of said groups for which codebook indices are comprised, and wherein said enhancement layer decoder is configured to take said identification of groups into account in generating said enhanced spectral first and second channel signals.

39. The apparatus according to claim 34, wherein said enhancement information further comprises an indication of a bitrate with which at least said state information and said enhancement information are provided, and wherein said enhancement layer decoder is configured to employ said bitrate indication for determining the amount of received enhancement information.

40. The apparatus according to claim 29, wherein said apparatus is one of: a multichannel audio decoder, a multichannel extension decoder for a multichannel audio decoder and a mobile terminal.

41. A multichannel audio coding system comprising the apparatus according to claim 15 and an apparatus comprising a stereo extension decoder implemented at least partly in hardware:

said stereo extension decoder configured to transform a received mono audio signal into the frequency domain, resulting in a spectral mono audio signal; and said stereo extension decoder configured to generate a spectral first channel signal and a spectral second channel signal out of said spectral mono audio signal by weighting said spectral mono audio signal separately in each of a plurality of adjacent frequency bands for each of said spectral first channel signal and said spectral second channel signal based on at least one gain value and in accordance with a received state information, said state information indicating for each of said adjacent frequency bands whether said spectral first channel signal, said spectral second channel signal or none of said spectral channel signals is to be dominant within the respective frequency band.

* * * * *